US007937020B2

(12) United States Patent
Sakurai et al.

(10) Patent No.: US 7,937,020 B2
(45) Date of Patent: May 3, 2011

(54) ELECTROPHOTOGRAPHIC IMAGE FORMING APPARATUS

(75) Inventors: Hiromi Sakurai, Susoni (JP); Chikara Imaizumi, Numazu (JP); Tomio Noguchi, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/732,558

(22) Filed: Mar. 26, 2010

(65) Prior Publication Data

US 2010/0209139 A1 Aug. 19, 2010

Related U.S. Application Data

(62) Division of application No. 11/622,183, filed on Jan. 11, 2007, now Pat. No. 7,715,752.

(30) Foreign Application Priority Data

Jan. 11, 2006 (JP) ..... 2006-004023

(51) Int. Cl.
*G03G 15/00* (2006.01)

(52) U.S. Cl. ..... 399/110; 399/107; 399/111; 399/113; 399/121

(58) Field of Classification Search ..... 399/107, 399/110, 111, 113, 121
See application file for complete search history.

(56) References Cited

U.S. PATENT DOCUMENTS 5,333,036 A 7/1994 Koga
5,371,575 A 12/1994 Sekino et al.
5,608,498 A 3/1997 Nagase et al.
2003/0053819 A1 3/2003 Nomura et al.
2005/0074259 A1 4/2005 Tachiki et al.
2006/0140669 A1 6/2006 Sato
2007/0160380 A1 7/2007 Imaizumi et al.
2007/0160384 A1 7/2007 Sakurai et al.
2007/0160385 A1 7/2007 Noguchi et al.
2008/0159772 A1 7/2008 Koishi et al.
2008/0159774 A1 7/2008 Tanabe et al.
2008/0159781 A1 7/2008 Noguchi et al.

FOREIGN PATENT DOCUMENTS

JP 2004-272289 9/2004

*Primary Examiner* — Ryan D Walsh
(74) *Attorney, Agent, or Firm* — Fitzpatrick, Cella, Harper & Scinto

(57) ABSTRACT

An electrophotographic image forming apparatus is usable with a process cartridge having an electrophotographic photosensitive member. The apparatus includes a transfer member contactable to the photosensitive member to transfer a toner image from the photosensitive member thereonto, a tray carrying the cartridge and movable between a contact position where the photosensitive member contacts the transfer member and a spaced position spaced from the transfer member, a supporting member supporting the tray for movement parallel with a tangent line between the photosensitive member and the transfer member between a first position positioning the tray at the contact position and a second position retracted from the first position away from the transfer member in a perpendicular direction perpendicular to the photosensitive-member axial direction and to the tangent line to position the tray at the spaced position, and engageable and engaging portions engageable with each other. The engaging portion regulates tray movement.

12 Claims, 21 Drawing Sheets

ELECTROPHOTOGRAPHIC IMAGE FORMING APPARATUS

This application is a divisional of U.S. application Ser. No. 11/622,183, filed Jan. 11, 2007, pending.

FIELD OF THE INVENTION AND RELATED ART

The present invention relates to an electrophotographic image forming apparatus, in which a process cartridge is removably mountable, and which is for forming an image on recording medium.

Here, an electrophotographic image forming apparatus means an apparatus for forming an image on recording medium, with the use of an electrophotographic image forming method. As examples of an electrophotographic image forming apparatus, an electrophotographic copying machine, an electrophotographic printer (for example, laser beam printer, LED printer, etc.), a facsimile machine, word processor, etc., can be included.

A process cartridge means a cartridge in which an electrophotographic photosensitive member, and processing means, such as a charging means, a developing means, etc., which process the electrophotographic photographic member, are integrally disposed, and which is removably mountable in the main assembly of the image forming apparatus.

A process cartridge, described above, can be mounted into, or removed from, the image forming apparatus main assembly by a user himself or herself. Therefore, it can simplify the maintenance of the apparatus main assembly.

There are various means for replacing a cartridge in the main assembly of an image forming apparatus. U.S. Pat. No. 5,608,498 discloses one of these means. According to this means, the main assembly of an image forming apparatus is provided with a cartridge supporting plate 61, which is raised or lowered as it is moved forward or rearward by the movement of the side cover 80 of the apparatus main assembly. A cartridge 30 is supported by the cartridge supporting plate 61, with a pair of guiding members 70, which are extendable in two stages, placed between the cartridge and cartridge supporting plate 61. As the side cover 80 is opened, the cartridge supporting plate 61 is moved by the movement of the side cover 80 in the upwardly slanting direction from the image formation position (I) to the cartridge mounting-extracting position (II), to allow the cartridge 30 to be removed directly from the cartridge supporting plate 61. With the employment of this structural arrangement, the cartridge supporting plate 61 can be moved into any location (specific position including intermediary stop position (III)) within the range in which the cartridge supporting plate 61 is movable, to mount or remove various devices, or deal with paper jam.

However, this structural arrangement in accordance with the prior art suffers from the following problem: when pushing the cartridge supporting plate 61 into the cartridge mounting-extracting position from the specific position including the intermediary stop position (III), the side cover 80 (door) can be closed even when the cartridge supporting plate 61 is not in the position (II). That is, it is not stated in U.S. Pat. No. 5,608,498 that the side cover 80 cannot be closed unless the operation for moving the guiding members 71 from the position (III) to the position (II) is completed.

In other words, if the side cover 80 is closed before the operation for moving the guiding members 71 from the position (III) to the position (II) is completed, it is possible that the downwardly facing area of the peripheral surface of the electrophotographic photosensitive member in the cartridge 30 will develop scars and/or permanent memories by being rubbed by the objects which are in the adjacencies of the downwardly facing area of the peripheral surface of the electrophotographic photosensitive member.

SUMMARY OF THE INVENTION

Thus, the primary object of the present invention is to provide an electrophotographic image forming apparatus in which a process cartridge is removably mountable, and which is characterized in that it does not suffer from the problem that the electrophotographic photosensitive member in a process cartridge develops scars and/or memories by being rubbed by the objects in its adjacencies.

According to an aspect of the present invention, there is provided an electrophotographic image forming apparatus with which a process cartridge having an electrophotographic photosensitive member is usable, said electrophotographic image forming apparatus comprising a transfer member contactable to said electrophotographic photosensitive member to transfer a toner image from said electrophotographic photosensitive member thereonto; a tray for carrying said process cartridge, said tray being movable between a contact position in which said electrophotographic photosensitive member is contacted to said transfer member in a state that tray carries said process cartridge and a spaced position in which said electrophotographic photosensitive member is spaced from said transfer member in the state that tray carries said process cartridge; a supporting member for supporting said tray for movement in a tangent line direction which is parallel with a tangent line between said electrophotographic photosensitive member and said transfer member as seen in an axial direction of said electrophotographic photosensitive member between a first position for positioning said tray at the contact position and a second position which is retracted from the first position away from said transfer member in a perpendicular direction perpendicular to the axial direction and to the tangent line and in the tangent line direction to position said tray at the spaced position; a portion to be engaged; and an engaging portion provided in said tray and engageable with said portion to be engaged to regulate movement of said tray in the tangent line direction when said tray is at the contact position, wherein said engaging portion is disengaged from said portion to be engaged after said electrophotographic photosensitive member is spaced from said transfer member by movement of said tray in the perpendicular direction in a state of engagement with said portion to be engaged, when said supporting member moves from the first position toward the second position.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

(General Structure of Image Forming Apparatus)

Figure 1:
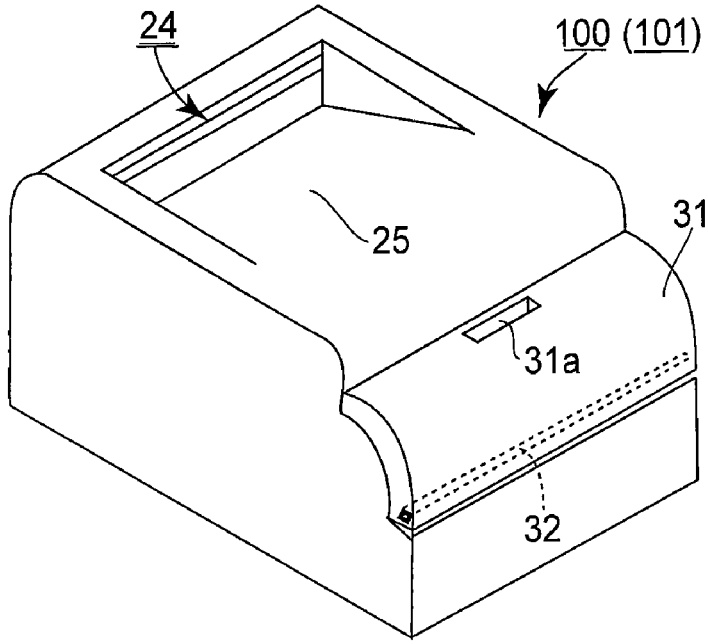
FIG. 1 is an external perspective view of the image forming apparatus in the first embodiment of the present invention.
Figure 2:
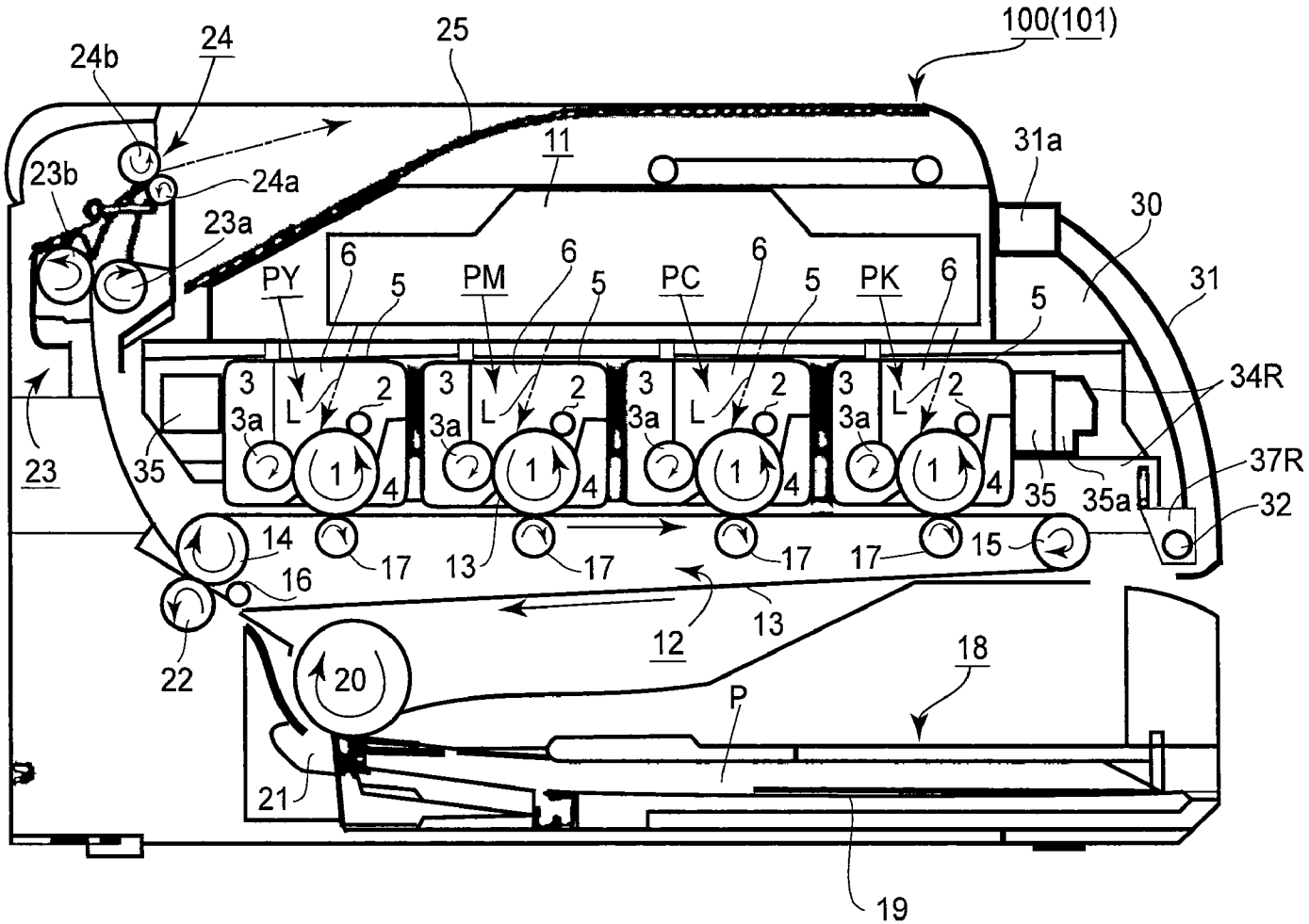
FIG. 2 is a vertical sectional view of the image forming apparatus shown in FIG. 1, as seen from the left side of the apparatus.

FIG. 1 is an external perspective view of the image forming apparatus 100 in this embodiment, and FIG. 2 is a vertical sectional view of the image forming apparatus 100, as seen from the left side of the apparatus. This image forming apparatus is a full-color laser printer based on four primary colors. It uses an electrophotographic process. It forms an image on recording medium (recording paper) in response to electric picture signals inputted from an external host apparatus (unshown) such as a personal computer, an image reader, a sending facsimile machine, etc.

In the following description of the preferred embodiment of the present invention, the front side (front surface side) of the image forming apparatus (which may be referred to as apparatus main assembly) means the side which has a door 31. The rear side of the image forming apparatus is the side opposite to the front side. "Frontward" means "in a direction toward front as seen from the rear side of the apparatus main assembly", and "rearward" means the direction opposite to "frontward". "The left and right sides of the apparatus main assembly" means the left and right sides of the apparatus main assembly as seen from the front side of the apparatus main assembly. "Leftward" means "in a direction toward left as seen from the front side", and "Rightward" means the direction opposite to "leftward".

There are four process cartridges (first to fourth), that is, PY, PM, PC, and PK, in the apparatus main assembly (main frame 80). The four cartridges PY, PM, PC, and PK are horizontally arranged in the listed order in terms of the rear-to-front direction (which may be referred to as inline or tandem arrangement). The four cartridges are the same in structure, although they are different in the color of the toners they store. Each cartridge in this embodiment is made up of: an electrophotographic photosensitive drum 1 as a first image bearing member; processing means, that is, a charging means 2, a developing means 3, and a cleaning device 4, which process the photosensitive drum 1; and a cartridge frame 5 (FIGS. 7 and 8), in which the preceding components are integrally disposed. The charging device 2 in this embodiment is a contact charge roller. The developing device 3 in this embodiment has a development roller 3*a*, and a developer container in which developer (toner) is stored. The cleaning device 4 is of the blade type.

The developing device 3 of the first cartridge PY stores yellow (Y) toner. On the peripheral surface of the drum 1 in the cartridge PY, a toner image of yellow (Y) color is formed. The developing device 3 of the second cartridge PM stores magenta (M) toner. On the peripheral surface of the drum 1 in the cartridge PM, a toner image of magenta (M) color is formed. The developing device 3 of the third cartridge PC stores cyan (C) toner. On the peripheral surface of the drum 1 in the cartridge PC, a toner image of cyan (C) color is formed. The developing device 3 of the fourth cartridge PK stores black (K) toner. On the peripheral surface of the drum 1 in the cartridge PK, a toner image of black (K) color is formed.

In the area above the cartridges PY, PM, PC, and PK, a laser scanner unit 11 is disposed. This scanner unit 11 exposes the peripheral surface of the drum in each cartridge. That is, the picture information regarding the image to be formed by each cartridge is inputted into the scanner unit 11 from an external host apparatus, and the scanner unit 11 outputs a beam of laser light L while modulating it with the picture information, so that the peripheral surface of the photosensitive drum in each cartridge is scanned (exposed) by the beam of laser light L through the exposure window 6 (FIGS. 7 and 8) with which the top wall of the cartridge frame 5 is provided.

In the area below the cartridge PY, PM, PC, and PK, an intermediary transfer belt unit 12 as a transferring member is disposed, which has an endless belt 13, a driver roller 14, a turn roller 15, and a tension roller 16. The endless belt 13 is formed of a dielectric substance, and is flexible. It is stretched around the driver roller 14, turn roller 15, and tension roller 16, being thereby suspended by them, so that it can be circularly driven. The driver roller 14 and tension roller 16 are disposed in the rear portion of the apparatus main assembly, whereas the turn roller 15 is disposed in the front portion of the apparatus main assembly. Each cartridge is disposed so that while the drum 1 in the cartridge and the endless belt 13 are driven, rotationally and circularly, respectively, the downwardly facing portion of the peripheral surface of the drum 1 remains in contact with the upwardly facing portion of the external surface of the endless belt 13. On the inward side of the loop which the belt 13 forms, four primary transfer rollers 17 are disposed. Each transfer roller 17 is disposed so that it opposes the drum 1 in the corresponding cartridge, with the portion of the endless belt 3, which corresponds to the top portion of the loop, pinched between the transfer roller 17 and photosensitive drum 1. The driver roller 14 is kept pressed against a secondary transfer roller 22, with the belt 13 pinched between the two rollers 14 and 22.

In the area below the belt unit 12, a paper feeder unit 18 is disposed, which has a paper feeder tray 19, a paper feeder roller 20, a paper separation pad 21, etc. The paper feeder tray 19 is removably mountable in the apparatus main assembly from the front side (front loading).

In the top portion of the rear portion of the apparatus main assembly, a fixing apparatus 23 and a paper discharging roller pair 24 are disposed. Further, the top wall of the frame (housing) of the apparatus main assembly is shaped so that a part of the housing is utilized as a delivery tray 25. The fixing apparatus 23 has a fixation film assembly 23*a* and a pressure application roller 23*b*. The paper discharging roller pair 24 has a paper discharging rollers 24*a* and 24*b*.

When each cartridge is in its latent image formation position in the apparatus main assembly, it is securely held in the latent image formation position by the pressure applied by a pressing member, which will be described later. Further, the driving force input portion of the cartridge is in engagement with the driving force output portion of the apparatus main assembly, and the electrical contacts of the cartridge are in connection with the corresponding electrical contacts of the apparatus main assembly, making it possible to provide the cartridge with the electric power from the power supply system on the apparatus main assembly side.

The operation carried out by this image forming apparatus to form a full-color image is as follow: Each of the first to fourth cartridges PY, PM, PC, and PK is rotationally driven at a preset (controlled) velocity in the counterclockwise direction indicated by an arrow mark. Further, the belt 13 is circularly driven in the clockwise direction indicated by an arrow mark (subordinate direction to rotational direction of photosensitive drum) at a velocity which corresponds to the peripheral velocity of the photosensitive drum 1. The scanner unit 11 is also driven. In synchronization with the driving of the scanner 11, the charge roller 2 in each cartridge uniformly charges the peripheral surface of the photosensitive drum 1 to preset polarity and potential, with a preset (controlled) timing. The scanner unit 11 scans (exposes) the peripheral surface of each photosensitive drum 1 with the beam of laser light L while modulating the beam of laser light L with the picture signals for forming an monochromatic image of the primary color assigned to each cartridge. As a result, an electrostatic latent image, which reflects the picture signals corresponding to the primary color assigned to the cartridge, is effected on the peripheral surface of the photosensitive drum 1. This electrostatic latent image is developed by the developing device 3 into a visible image, that is, an image formed of toner (which hereafter will be referred to as toner image).

Through the above described electrophotographic image formation process, a yellow toner image, which corresponds to the yellow color component of an intended full-color image is formed on the drum 1 of the first cartridge PY. This yellow toner image is transferred (primary transfer) onto the belt 13.

On the drum 1 of the second cartridge PM, a magenta toner image, which corresponds to the magenta color component of the full-color image is formed, and this toner image is transferred (primary transfer) onto the belt 13 so that it is layered on the yellow toner image which is already on the belt 13.

On the drum 1 of the second cartridge PC, a cyan toner image, which corresponds to the cyan color component of the full-color image is formed, and this toner image is transferred (primary transfer) onto the belt 13 so that it is layered on the yellow and magenta toner images which are already on the belt 13.

On the drum 1 of the second cartridge PK, a black toner image, which corresponds to the black color component of the full-color image, is formed, and this toner image is transferred (primary transfer) onto the belt 13 so that it is layered on the yellow, magenta, and cyan toner images which are already on the belt 13.

Consequently, an unfixed full-color toner image is effected on the belt 13 by the four monochromatic color images, that is, the yellow, magenta, cyan, and black color images.

After the primary transfer of the toner image onto the belt 13, the toner remaining on the peripheral surface of the drum 1 in each cartridge is removed by the cleaning device 4.

Meanwhile, the paper feeder roller 20 is driven with the preset (controlled) timing. As the paper feeder roller 20 is driven, the topmost sheet of recording paper P, as recording medium, of the stack of sheets of recording paper P on the paper feeder tray 19 is separated from the rest of the sheets of recording medium by the coordination of the sheet feeder roller 20 and separation pad 21, and is fed into the apparatus main assembly by the sheet feeder roller 20. The recording paper P is introduced into the nip (secondary transfer nip), that is, the interface between the secondary transfer roller 22 and belt 13, and then, is conveyed through the nip while remaining pinched by the secondary transfer roller 22 and belt 13. While the recording paper P is conveyed through the nip, the four layers of toner images different in color are transferred together onto the recording paper P as if they were peeled away from the belt 13, starting their leading edges.

The recording paper P is separated from the surface of the belt 13, and is introduced into the fixing apparatus 23, and is subjected to heat and pressure in the fixation nip of the fixing apparatus 23. As a result, the four layers of toner images different in color are fixed to the recording paper P. Thereafter, the recording paper P is moved out of the fixing apparatus, and then, is discharged as a full-color copy onto the delivery tray 25 by the discharge roller pair 24.

In this embodiment, after the separation of the recording paper P from the belt 13, the toner remaining on the surface of the belt 13 is electrostatically adhered to the peripheral surface of the drum 1 of the first process cartridge PY, for example, in the primary transfer area between the first process cartridge and photosensitive drum 1, and then is removed by the cleaning device 4 of the first process cartridge PY.

(Method for Replacing Cartridge)

As an image forming operation is carried out by each of the first to fourth cartridges PY, PM, PC, and PK, the developer (toner) stored in the developing device 3 of each cartridge is consumed. Eventually, therefore, the amount of the developer in the developing device 3 becomes too small to form an image which is satisfactory to the user who purchased the cartridge; in other words, the cartridge loses its commercial value.

Thus, the image forming apparatus is provided with a means (unshown) for detecting the amount of the toner remaining in each cartridge. The detected amount of the toner in each cartridge is compared, by the control portion of the image forming apparatus, with a threshold value preset for issuing a warning, such as the cartridge is near the end of its service life, or the cartridge has reached the end of its service life. If the detected amount of the residual toner in the cartridge is smaller than the preset threshold value, the message which warms the user that the cartridge is close to the end of its life or has reached the end of its life is displayed on the screen of the monitor; in other words, the image forming apparatus prompts the user to prepare a replacement cartridge, or to replace the cartridge, in order to maintain a preset level of image quality.

In order to improve the image forming apparatus in usability, the image forming apparatus in this embodiment is provided with a cartridge drawer (tray) which can be pulled out frontward to make it easier for a user access the cartridges from the front side of the apparatus, in order to replace the cartridge.

More specifically, the front wall of the image forming apparatus is provided with an opening 30 (FIG. 2), through which the cartridge can be inserted into, or removed from, the apparatus main assembly. That is, the apparatus main assembly (apparatus main frame 101) has the opening 30.

Further, the apparatus main assembly is provided with a door 31, which is attached to the main assembly frame 101 so that it can be rotationally moved between the closed position and open position.

Figure 3:
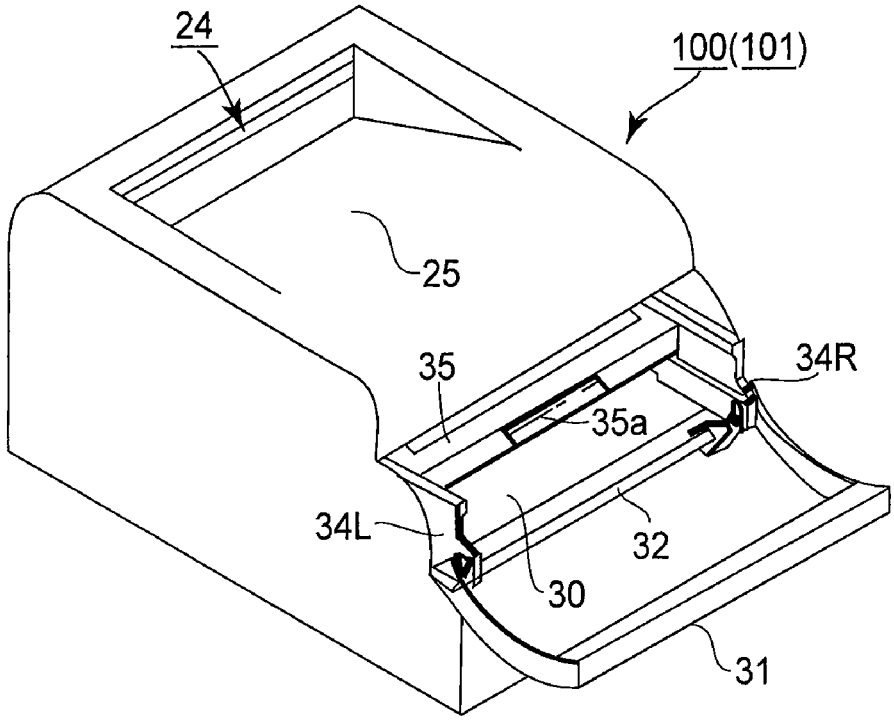
FIG. 3 is an external perspective view of the image forming apparatus, the front door of which is open.
Figure 4:
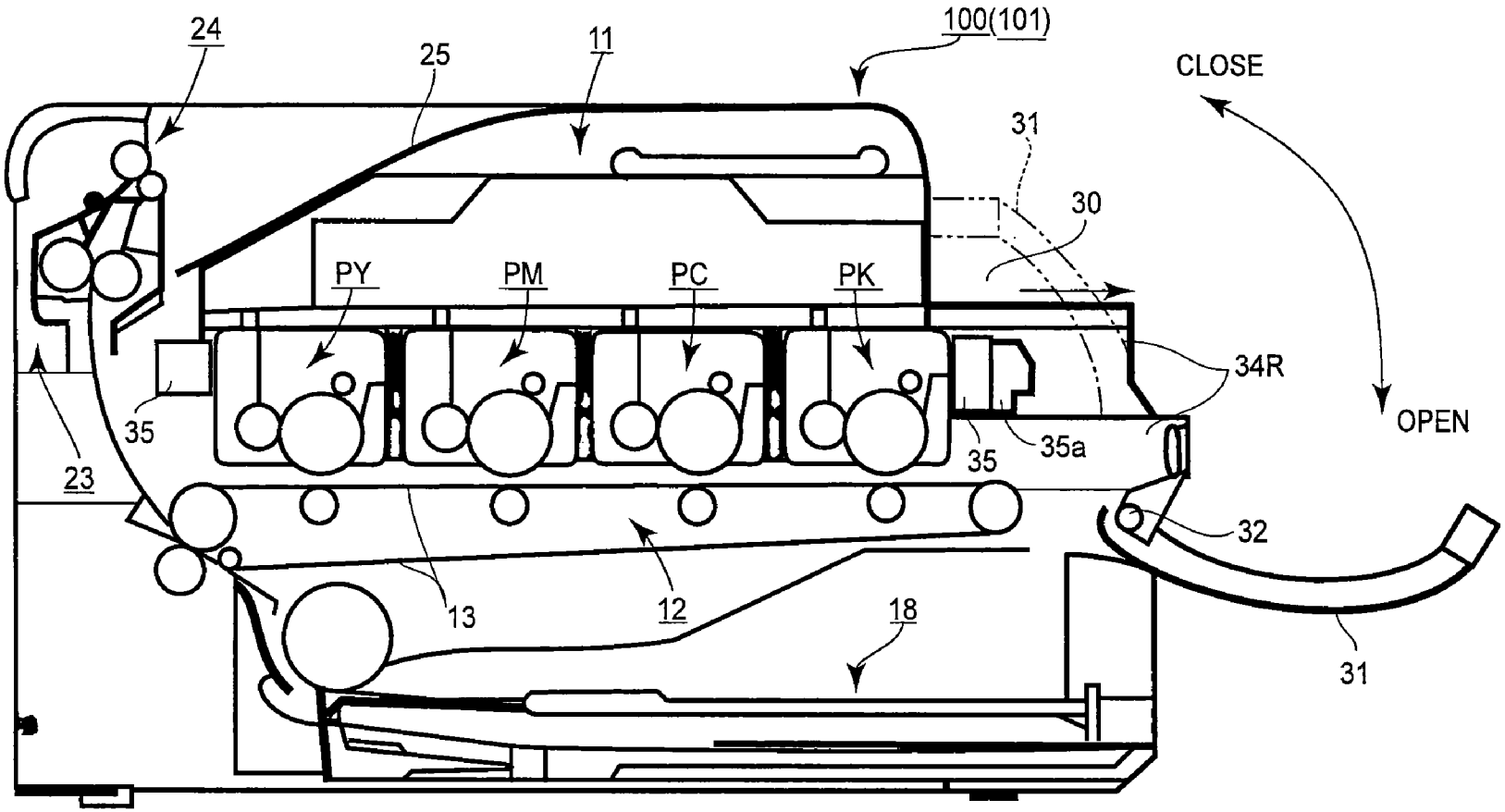
FIG. 4 is a vertical sectional view of the image forming apparatus, shown in FIG. 3, the front door of which is open, as seen from the left side of the apparatus.

In this embodiment, this door 31 is rotationally moved relative to the apparatus main assembly about a horizontal shaft 32 (door hinge shaft) located at one of the horizontal edges of the door. That is, the door 31 is rotated about the hinge shaft 32 so that it can be moved into the closed position (roughly vertical position), in which it remains shut against the apparatus main frame, covering the opening 30, as shown in FIGS. 1 and 2, and also, so that it can be rotated frontward about the hinge shaft 32 into the open position (roughly horizontal position), as shown in FIGS. 3 and 4, widely exposing the opening 30 of the front panel of the apparatus main frame 101. Designated by a referential character 31*a* is a recess for finger placement, with which the door 31 is provided to make it easier for an operator to open or close the door 31.

The left and right panels 81L (FIG. 17) and 81R which constitute the primary components of the apparatus main assembly are provided with a pair of tray holding (supporting) members 34L and 34R, respectively, which are on the inward side of the left and right panel 81L and 81R, and the lengthwise direction of which coincides with the fore-and-aft direction of the apparatus main assembly. The holding members 34L and 34R oppose each other. Between the holding members 34L and 34R, a cartridge tray (moving member) 35, which is in the form of a box frame, is disposed. The holding members 34L and 34R hold the tray 3 so that the tray 35 can be horizontally slid in the fore-and-aft direction of the apparatus main assembly. The tray 35 holds the cartridges PY, PM, PC, and PK.

As the door 31 is opened, the holding members 34L and 34R are moved both frontward and upward of the apparatus main assembly by preset distances, by the movement of the door 31 transmitted to the holding members 34L and 34R through a mechanical linkage. This movement of the holding members 34L and 34R will be described later in more detail. As a result, the holding members 34L and 34R come out of the apparatus main assembly through the opening 30 so that the front end portion of each holding member 34 extends outward of the apparatus main assembly by a preset distance, as shown in FIGS. 3 and 4. The mechanical linkage which causes the movement of the door 31 to move the holding members 34L and 34R will be described later in more detail.

As the holding members 34L and 34R are moved, the driving force output portions on the apparatus main assembly side are disengaged from the corresponding driving force input portions of the cartridges PY, PM, PC, and PK, respectively. Further, the pressure applied to each cartridge by the pressure application member to secure the cartridge is removed from the cartridge (pressure removal). Further, the electrical contacts of each cartridge are disengaged from the counterparts on the apparatus main assembly side, making it thereby impossible for electric power to be supplied to the cartridge from the power supplying system on the apparatus main assembly side (electrical disengagement). Moreover, the tray 35 is rendered freely movable.

Figure 5:
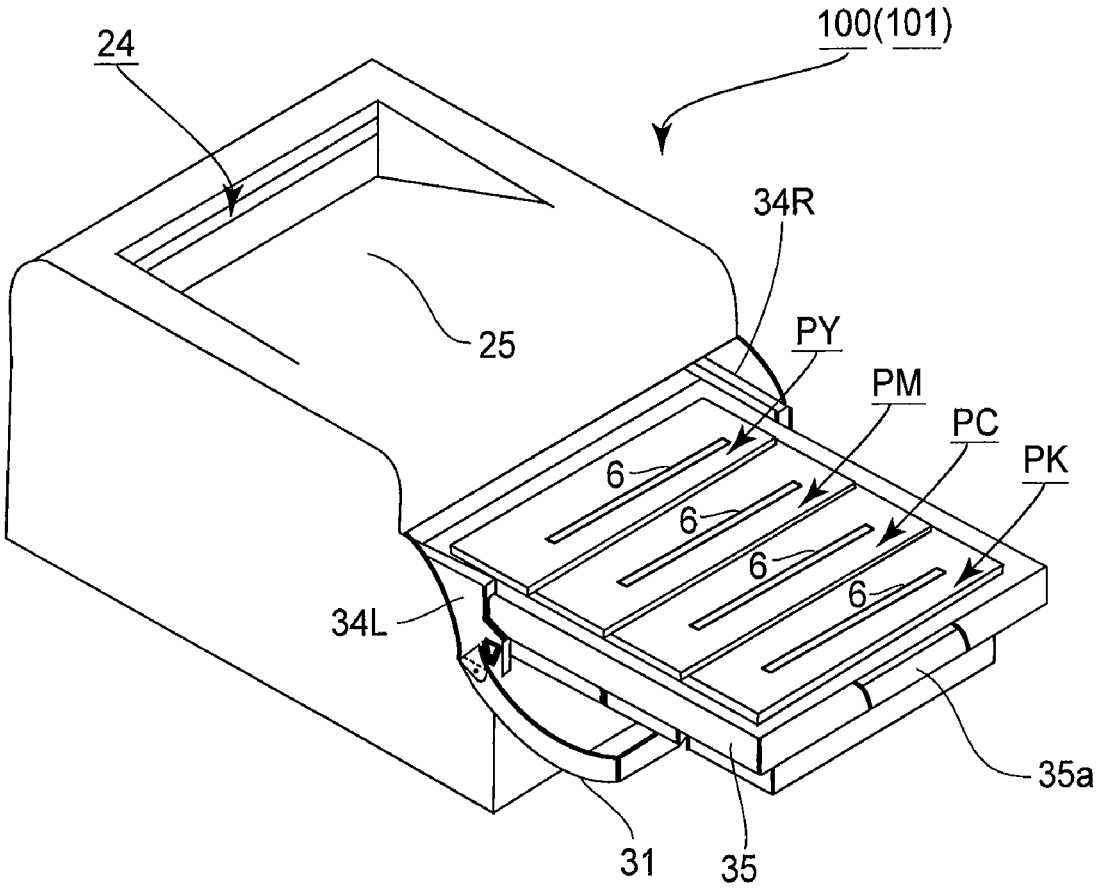
FIG. 5 is an external perspective view of the image forming apparatus, shown in FIG. 1, the cartridge tray of which is in its outermost position.
Figure 6:
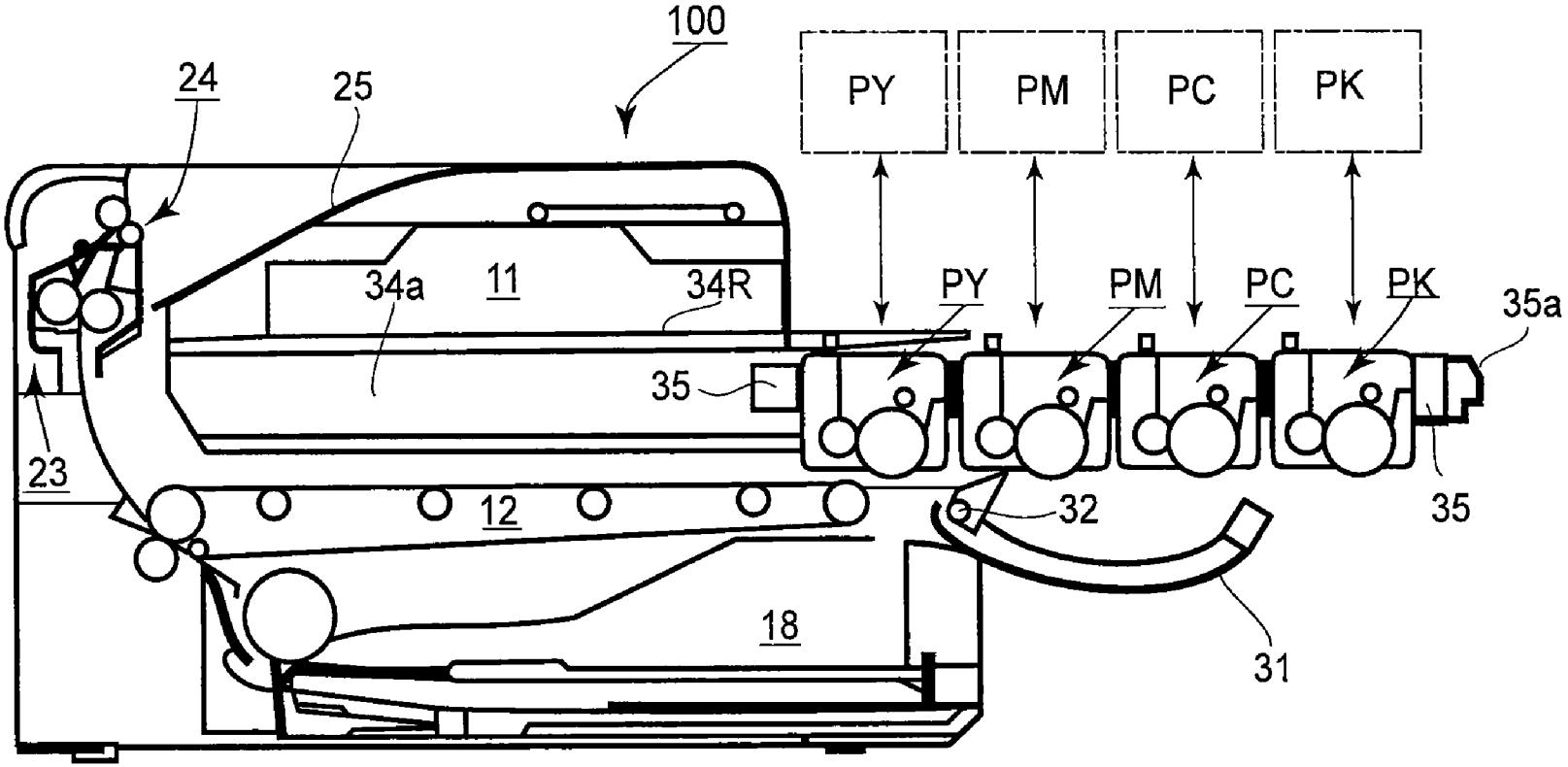
FIG. 6 is a vertical sectional view of the image forming apparatus, shown in FIG. 5, the cartridge tray of which is in its outermost position, as seen from the left side of the apparatus.

The front portion of the frame portion of the tray 35 is provided with a handle 35*a*. Thus, as the door 31 is opened, the handle 35*a* is exposed through the opening 30. An operator is to place a finger on the handle 35*a* and pull the tray 35 horizontally frontward to cause the tray 35 to slide on the holding members 34L and 34R until the tray 35 fully comes out through the opening 30 to a preset position, as shown in FIGS. 5 and 6.

As the tray 35 is pulled out to the abovementioned preset position, the first-fourth cartridges PY, PM, PC, and PK held in the tray 35 are all moved out of the apparatus main assembly through the opening of the apparatus main assembly, being exposed from the apparatus main assembly; the top surface of each cartridge is exposed. The apparatus main assembly is structured so that as the tray 35 is pulled out by a preset distance which is sufficient to expose all the cartridges, it is prevented by a stopper portion (unshown) from being pulled out further, and also, so that once the tray 35 is fully pulled out, it is securely retained in this outermost position by the holding members 34L and 34R.

The tray 35 is structured so that each cartridge held in the tray 35 can be moved out straight upward from the tray 35, and also, so that the replacement cartridge for each of the first to fourth cartridges can be mounted into the tray 35 from directly above. Thus, the cartridge or cartridges, which are to be replaced, that is, the cartridge or cartridges, the life of which has expired, can be extracted from the tray 35 by simply lifting it, and then, a bran-new cartridge or cartridges can be fitted, from directly above, into the vacated space or spaces, one for one, in the tray 35.

Incidentally, if the removed cartridge is provided with a manual drum cover (unshown) for protecting the bottom side of the drum 1, the cover is to be manually closed after the removal of the cartridge from the tray 35. As for a brand-new cartridge to be mounted as a replacement cartridge into the tray 35, its cover should be manually opened before it is placed in the tray 35. On the other hand, if the removed cartridge is provided with an automatic drum cover (unshown) for protecting the bottom side of the drum 1, the cover is automatically closed as it is lifted directly upward from the tray 35. As for a brand-new cartridge to be mounted as a replacement cartridge into the tray 35, its cover is automatically opened as it is fitted into the tray 35 from directly above.

The tray 35 described above is a member that is movable in the direction intersectional to the axial direction of the drum 1 in each cartridge. Further, the tray 35 is enabled to take the outermost position (cartridge mounting or removing position), the latent image formation position (contact position), and the transitional position. The outermost position is the position in which the cartridge 35 will be after it is drawn out from the apparatus main assembly through the opening 30 as far as possible, and also, is the position in which the tray 35 allows the cartridges to be mounted into, or removed from, the tray 35. The latent image formation position is the position which is in the main assembly frame 101, and in which the tray 35 enables the image forming apparatus to form an electrostatic latent image on the drum 1 in each cartridge in the tray 35. The transitional position means a position between the outermost position and latent image formation position. Incidentally, when the tray 35 is in the transitional position or outermost position, the drum 1 in each cartridge is not in contact with the belt 13.

The left and right holding members 34L and 34R constitute a means for controlling the movement of the tray 35. That is, they move upward the tray 35 from the latent image formation position before they move the tray 35 to the abovementioned outermost position. They also move downward the tray 35 into the abovementioned latent image formation position. In other words, the holding members 34L and 35R are enabled to take the first position, in which they allow the tray 35 to be moved between the abovementioned outermost position and transitional position, and the second position, in which they retain the tray 35 in the abovementioned latent image formation position. As the door 31 is closed, the holding members 34L and 34R are moved from the first position to the second position by the movement of the door 31.

Figure 7:
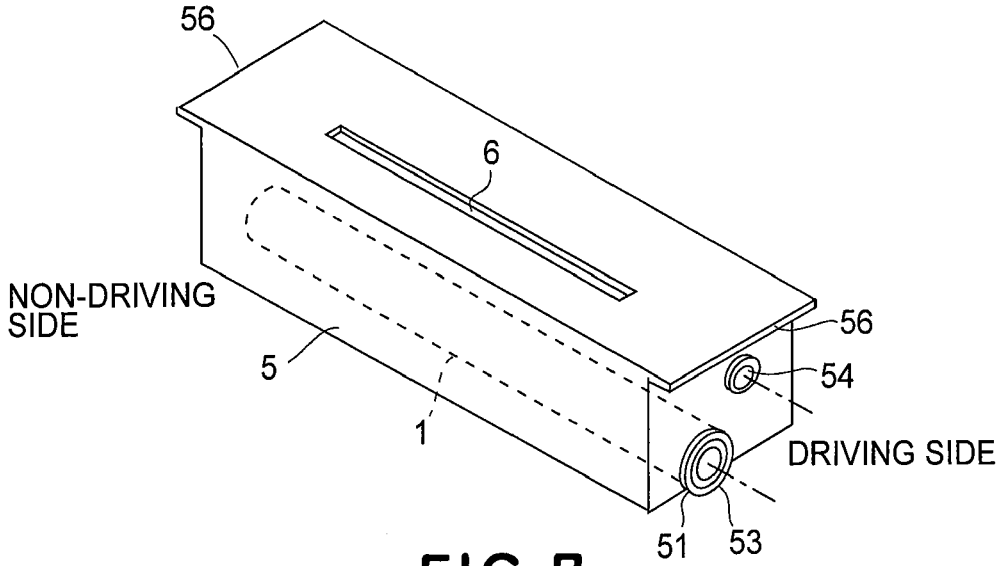
FIG. 7 is an external perspective view of the cartridge, as seen from the side from which the cartridge is driven.
Figure 8:
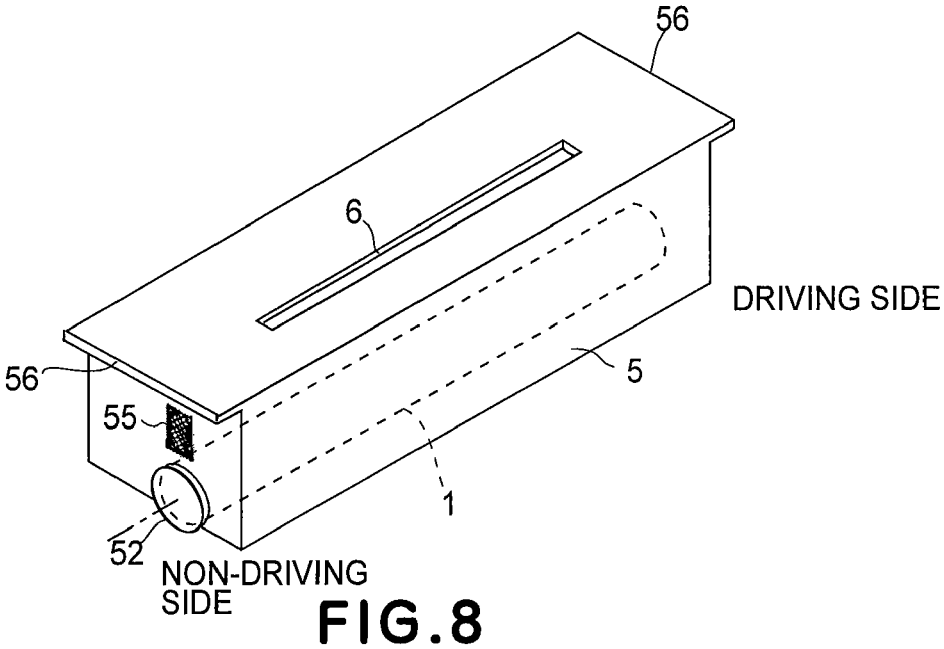
FIG. 8 is an external perspective view of the cartridge, as seen from the side from which the cartridge is not driven.

FIGS. 7 and 8 are external perspective views of one of the cartridges, as seen from the side from which the cartridge is driven, and the side from which the cartridge is not driven, respectively.

In this embodiment, when a cartridge is in the apparatus main assembly, the leftward or rightward direction of the cartridge is the direction parallel to the axial line of the drum 1. Each cartridge is an assembly of various components, and is roughly in the form of a rectangular parallelepiped, the lengthwise direction of which coincides with the above-mentioned leftward or rightward direction. The drum 1 in each cartridge is disposed between the right and left walls of the frame 5 (housing) of the cartridge, being supported by a pair of bearing portions 51 and 52 with which the right and left walls are provided, respectively; in other words, the drum 1 is rotatably supported by the housing 5. The right bearing portion 51 is provided with a coupler 53 as a portion through which the drum driving force is inputted. Further, the right wall of the housing 5 is provided with a coupler 54 as a portion through which the development roller driving force is inputted. The left wall of the housing 5 is provided with electrical contacts 55 of the cartridge. The housing 5 is provided with a pair of overhangs 56, which extend from the right and left ends of the top wall of the housing 5, respectively. In the following description of the cartridge, the right-hand side of the cartridge, that is, the side having the couplers 53 and 54, may be referred to as drivable side, and the left-hand side, that is, the opposite side from the right-hand side, may be referred to as nondrivable side.

Figure 9:
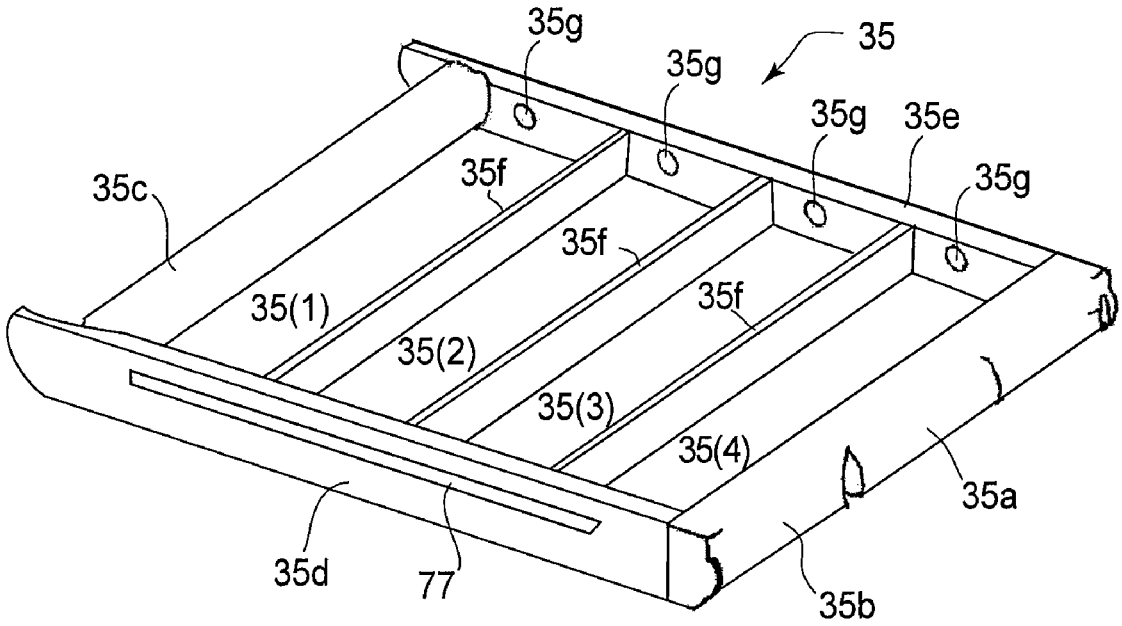
FIG. 9 is a perspective view of the cartridge tray.

FIG. 9 is an external perspective view of the tray 35. The tray 35 has a rectangular main frame, which is made up of four sections 35*b* (front), 35*c* (rear), 35*d* (left), and 35*e* (right), which are formed of a metallic substance and are joined at their lengthwise ends. The space within the rectangular main frame is partitioned into four sub-spaces of roughly the same size by three partition walls 35*f* which extend in the fore-and-aft direction, connecting the left and right sections of the main frame. Hereafter, these four sub-spaces will be referred to as first-fourth spaces 35(1)-35(4), listing from the rear section 35*c* side toward the front section 35*b*. These sub-spaces 35(1)-35(4) are the spaces in which the first to fourth cartridges PY, PM, PC, and PK are held. The portions of the rear section 35*e* of the main frame of the tray 35, which correspond to the sub-spaces 35(1)-35(4), are provided with a hole 35*g*, which is for allowing the development roller driving coupler 35*g* to move into, or out of, the corresponding subspace.

Further, the tray 35 is provided with intermediary electrical contacts 72*a*-72*d* (FIG. 21), each of which makes contact with the electrical contact 55 (FIG. 8) of the corresponding cartridge. These intermediary electrical contacts 72*a*-72*d* are electrically connectible to the electrical contacts 75*a*-75*d* (FIGS. 21 and 22) with which the apparatus main assembly is provided. These electrical contacts and their connection will be described later.

Each cartridge is to be inserted from directly above into one of the sub-spaces of the tray 35, which has been predesignated for the cartridge. As the cartridge is inserted, the left and right overhangs 56 are caught, by their bottom surfaces, by the top surfaces of the left and right sections 35*d* and 35*e* of the main frame of the tray 35; in other words, the cartridge is supported by the tray 35. That is, the tray 35 supports each cartridge so that the cartridge can be removed from the tray 35 in the vertically upward direction; in other words, as each cartridge is moved downward into the tray 35 from directly above the tray 35, the cartridge is supported by the tray 35. With the employment of the above described structural arrangement, the four cartridges PY, PM, PC, and PK are precisely positioned in the tray 35, without being fastened to the tray 35. Therefore, they can be easily replaced.

The inward surface of the left holding member 34L and the inward surface of the right holding member 34R are provided with a guiding groove 34*a* (FIGS. 6, 10, and 21) which extends in the fore-and-aft direction. The left and right sections of the main frame of the tray 35 fit in these grooves 34*a*, one for one. Thus, not only is the tray 35 supported between the left and right holding members 34L and 34R, but also, it is allowed to slid in the fore-and-aft direction, with the front and rear sections 35*d* and 35*e* of its main frame sliding in the guiding grooves 34*a* of the holding members 34L and 34R.

Referring to FIGS. 5 and 6, after the tray 35 is drawn out into its outermost position, and the cartridge, or cartridges, in the tray 35, which are to be replaced, are replaced, the tray 35 is to be pushed in the direction opposite to the direction in which it is pulled out of the apparatus main assembly; in other words, the tray 35 is to be pushed back into the apparatus main assembly (it is to be moved back into the transitional position). Then, the tray 35 is to be moved back into the latent image formation position). Then, the tray 35 is to be returned to the position, shown in FIGS. 3 and 4, in which the tray 35 was before it was pulled out. Thereafter, the door 31 is to be closed against the housing of the apparatus main assembly, as shown in FIGS. 1 and 2.

As the door 31 is closed, the holding members 34L and 34R are moved downwardly rearward, by the preset distance, by the movement of the door 31. As a result, the tray 35 is moved from the transitional position into the latent image formation position. Further, the movement of the holding members 34L and 34R causes the cartridge pressing members to apply pressure to the corresponding cartridges to secure the cartridges in their preset positions. As a result, the downwardly facing area of the peripheral surface of the drum 1 in each cartridge comes into contact with the point (area) of the belt 13, which coincides with the specific point preset for each cartridge, in terms of the fore-and-aft direction. Then, each of the driving force outputting portions of the apparatus main assembly engages with the driving force input portion of the corresponding cartridge, and the power supply system of the apparatus main assembly is electrically connected to the electrical contact of each cartridge.

(Mechanical Linkage Between Door 31 and Tray Holding Members 34L and 34R)

Figure 10:
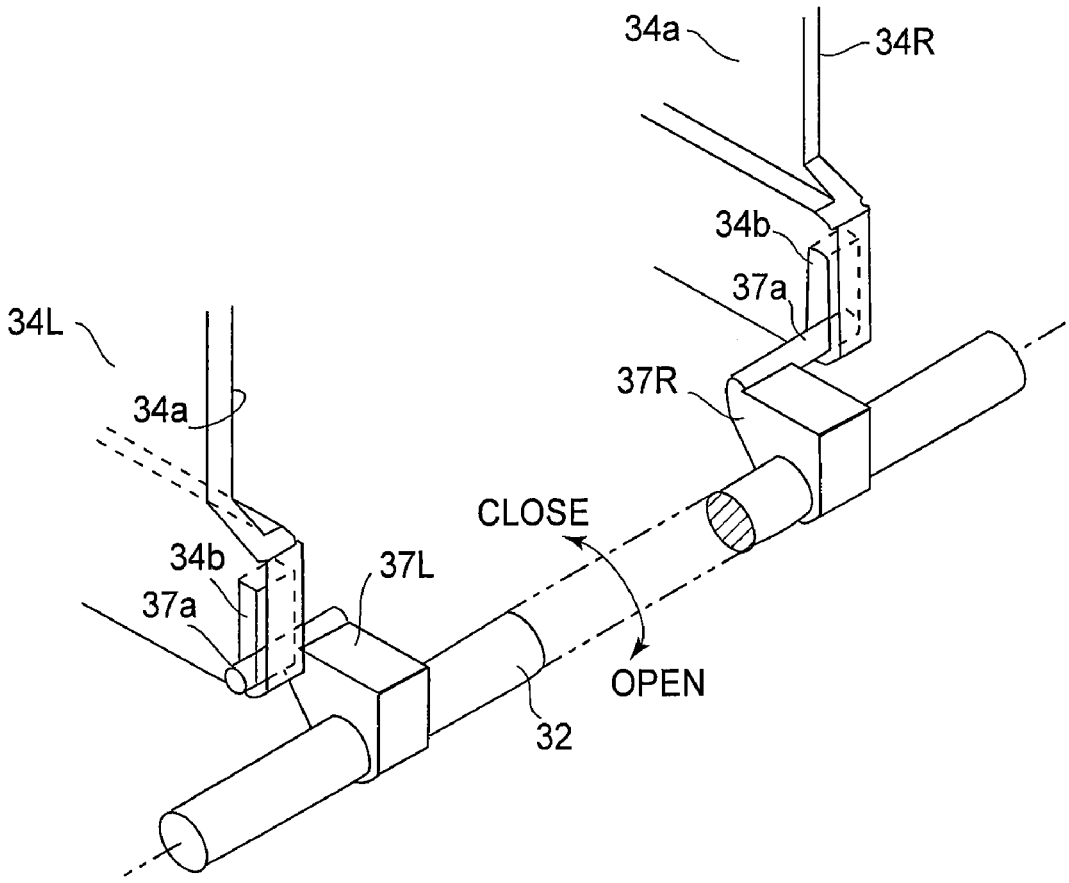
FIG. 10 is a perspective view of the mechanical linkage between the door and tray holding members.

FIG. 10 is a perspective view of the mechanical linkage between the door 31 and tray holding members 34L and 34R. The hinge shaft 32 of the door 31 is horizontally disposed in parallel to the left and right direction of apparatus main assembly. The hinge shaft 32 is rotatably supported at its lengthwise ends by, and between, the left and right frames 80L and 80R (FIG. 17) of the apparatus main assembly, with a pair of bearings placed between the hinge shaft 32 and left and right frames 80L and 80R, one for one. The door 31 is solidly attached to the hinge shaft 32. Thus, as the door 31 is opened or closed, the hinge shaft 32 rotates with the door 31. The hinge shaft 32 is provided with a pair of connective arms 37L and 37R, which are attached to the portions of the hinge shaft 32, which are close to the left and right lengthwise ends of the hinge shaft 32. The arms 37L and 37R are solidly attached to the hinge shaft 32 so that they are the same in rotational phase. The arms 37L and 38R are provided with their own horizontal shaft 37*a*. The horizontal arm 37*a* of the left arm 37L is fitted in a hole 34*b* with which the bottom front portion of the left holding member 37L is provided, and the horizontal shaft 37*a* of the right arm 37R is fitted in a hole 34*b* with which the bottom front portion of the right holding member 34R is provided. Both holes 34*b* are elongated in cross-section.

In other words, the hinge shaft 32 is connected to the holding members 34L and 34R, with the interposition of the arms 37L and 37R, horizontal shafts 37*a*, and holes 34*b*. Thus, as the door 31 is opened or closed, the force applied to the door 31 to move the door 31 is transmitted to the left and right holding members 34L and 34R in a manner to move them in the fore-and-aft direction.

Each of the holding members 34L and 34R is provided with a pair of pins 34*c*, which protrude from the front and rear portions (with presence of preset distance) of the holding member. Further, each of the left and right frames 80L and 80R are provided with a pair of guiding slots 36. The pins 34*c* are fitted in these guiding slots 36, one for one, whereby the holding members 34L and 34R are supported by the left and right frames 80L and 80R.

Figure 11A:
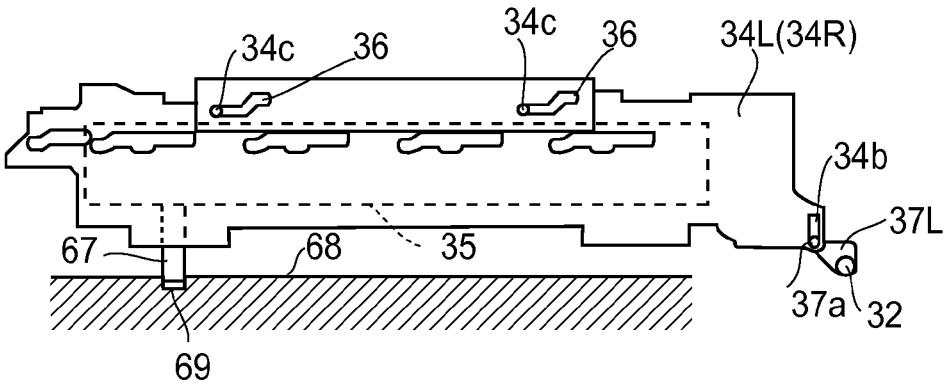
FIGS. 11(*a*)-11(*c*) are schematic drawings showing the movement of the tray holding member, which is caused by the rotational door movement which occurs when the door is opened.
Figure 11B:
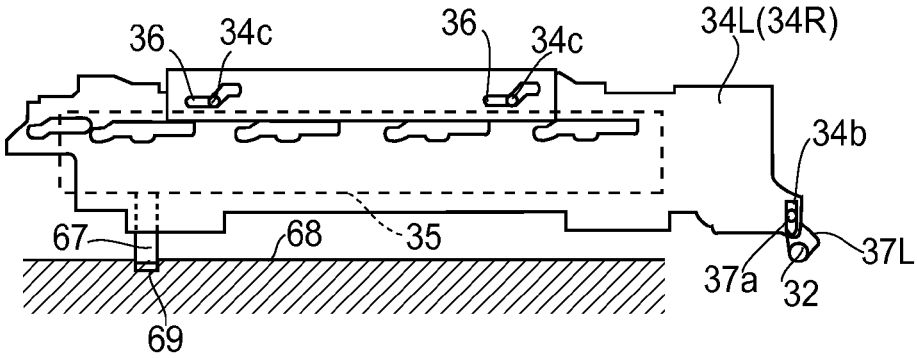
Figure 11C:
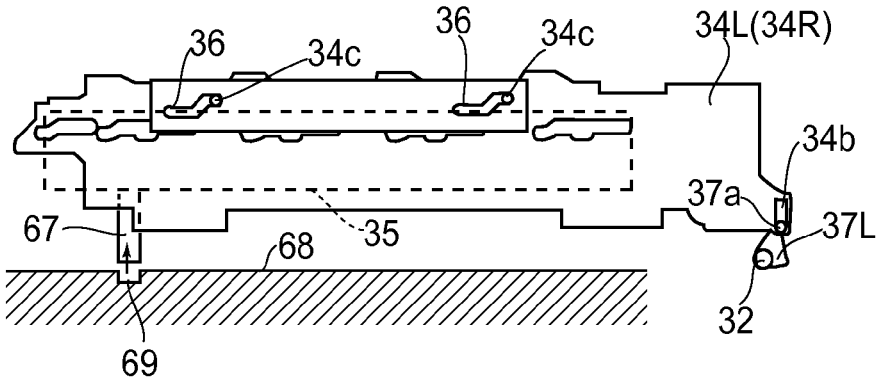

FIGS. 11(*a*)-11(*c*) show the two pins 34*c* of the left holding member 34L, and the guiding slots 36 of the left frame 80L. It does not show the right holding member 34R. But, the right holding member 34R is the same as the left holding member 34L, except that its pins 34*c* and the corresponding guiding slots 36 of the left frame 80L are symmetrically positioned relative to those of the left holding members 34L and the corresponding guiding slots 36.

Therefore, the left and right holding members 34L and 34R are allowed to move relative to the left and right frames 80L and 80R, within the range set by the guiding slots 36. That is, the holding members 34L and 34R are supported by the frame (housing) 101 of the apparatus main assembly so that they are allowed to move relative to the frame 101.

Figure 12:
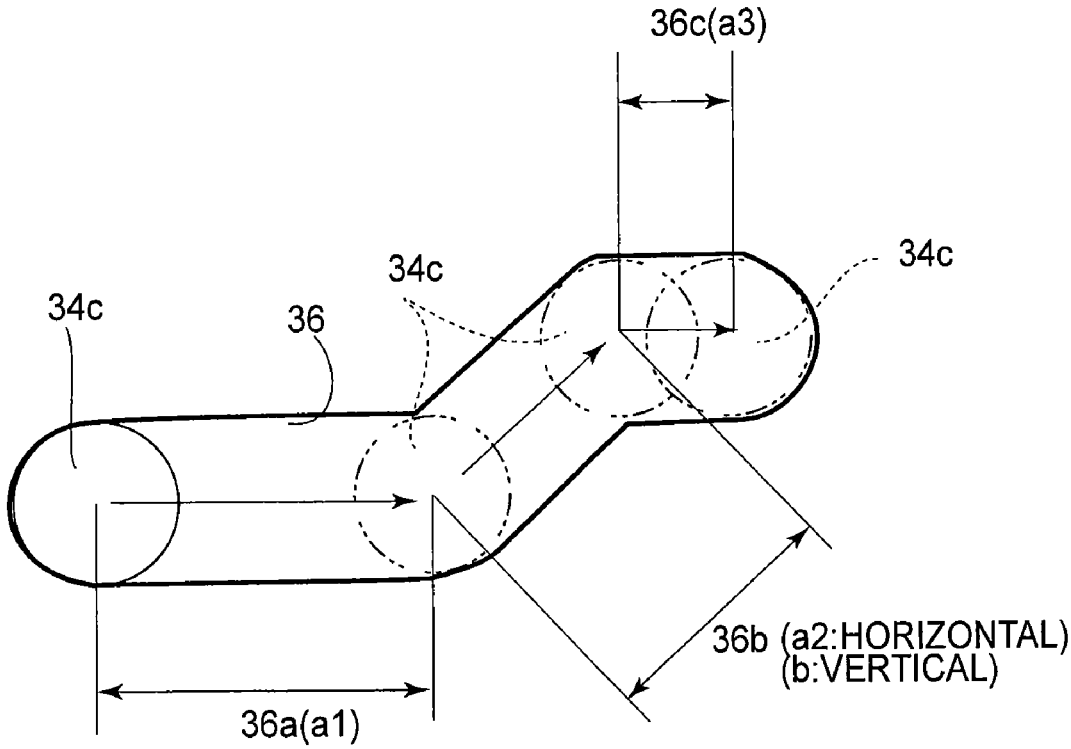
FIG. 12 is an enlarged view of the guiding slot.

FIG. 12 is an enlarged view of one of the guiding slot 36. Each guiding slot 36 is made up of first, second, and third guiding section 36*a*, 36*b*, and 36*c*. The first guiding section 36*a* horizontally extends in the fore-and-aft direction. The second guiding section 36*b* extends frontward from the front end of the first section 36*a*, slanting upward. The third guiding section 36*c* horizontally extends from the front end of the second guiding section 36*b*, being therefore positioned higher than the first guiding section 36*a*. The third guiding section 36*c* constitutes the section which catches and holds the pin 34*c*.

As the door 31 is opened, the pins 34*c* (and the holding members 34L and 34R) are moved a distance a1, by the movement of the door 31, while being horizontally (direction parallel to line which is tangential to peripheral surface of drum 1 and coincides with center of contact area between drum 1 and belt 13) guided by the first guiding section 36*a* of the guiding slot 36, and then, is moved slantingly upward (horizontally moved by distance a2, and vertically (direction perpendicular to above-mentioned tangential line and axial line of photosensitive drum 1) moved by distance b) while being guided by the second guiding section 36*b*. Then, finally, they are horizontally moved a distance a3 while being guided by the third guiding section 36*c*. Thus, as the door 31 is opened, the holding members 34L and 34R are moved in the same manner as the pins 34*c*, because the pins 34*c* are attached to the holding members 34L and 34R.

FIG. 11(*a*) shows the state of the mechanical linkage between the door 31 and tray holding members 34L (R), in which the door 31 is completely shut. When the mechanical linkage is in this state, the holding members 34L and 34R are in their rearmost positions in the apparatus main assembly. The holding members 34L and 34R are supported by the apparatus main assembly with the presence of the hinge shaft 32, connective arms 37L and 37R, horizontal shafts 37*a*, and holes 34*b* between the door 31 and holding members 34L and 34R. Further, the pin 34*c* is located at the rear end of the first guiding section 36*a* of the guiding slot 36. Therefore, the holding members 34L and 34R are in their lowest positions (abovementioned second positions) relative to the left and right frames 80L and 80R. Therefore, the tray 35 is also in its lowest position (abovementioned latent image formation position), because the tray 35 is held by the holding members 34L and 34R.

Each of the cartridges PY, PM, PC, and PK in the tray 35 is under the pressure applied to its left and right shoulder portions by the above-mentioned pressing member. Thus, the bottom side (by which cartridge is accurately positioned) of the peripheral surface of the bearing 51, that is, the bearing on the driven side, and the bottom side (by which cartridge is accurately positioned) of the peripheral surface of the bearing 52, that is, the bearing on the nondriven side, are pressed upon the positioning portions, one for one, with which the stays (internal panels) of the apparatus main assembly is provided. The cartridge tends to rotate about the axial lines of the bearings 51 and 52. However, the contact between the rotation stopper, as the cartridge positioning portion, with which the rear section 35*d* of the tray 35 is provided, and a part of the cartridge, prevents the cartridge from rotating about the axial lines of the bearings 51 and 52. That is, the metallic rear section 35*d* of the tray 35 also serves as the cartridge positioning portion. Thus, each cartridge is accurately positioned relative to the apparatus main assembly. Also, when the mechanical linkage is in the state shown in FIG. 11(*a*), the downwardly facing area of the drum 1 in each cartridge reliably remains in contact with the outward surface of the top side of the belt 13 of the belt unit 12.

The coupler 53 and 54 of each cartridge are coupled with the drum driving coupler and development roller driving coupler, respectively, with which the apparatus main assembly is provided.

To the electrical contact 55 of each cartridge, electric power can be supplied from the apparatus main assembly through the corresponding intermediary electrical contact.

The tray 35 (metallic rear section 35*d*) is provided with a protrusion 67, which protrudes downward from the bottom left portion of the tray 35 (metallic rear section 35*d*). An intermediary transfer belt holding member 68, which is a stationary member of the apparatus main assembly, is provided with a hole 69 (FIGS. 11(*a*), 11(*b*), 11(*c*), and 13(*a*)). The tip portion of the protrusion 67 of the tray 35 is fitted (engaged) in the hole 69, whereby the tray 35 is precisely positioned relative to the apparatus main assembly.

Figure 13A:
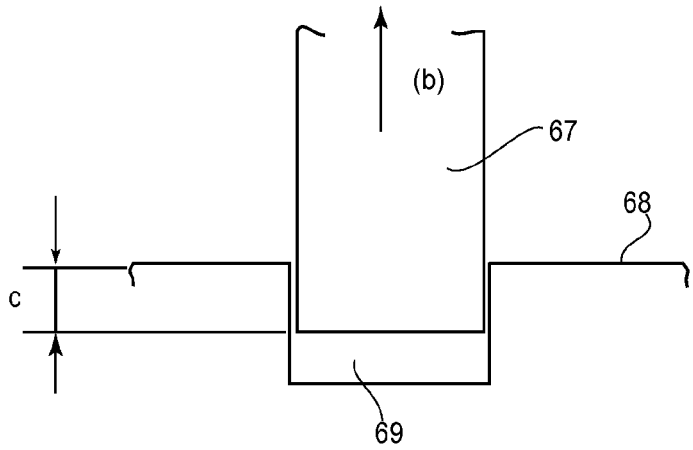
FIGS. 13(*a*) and 13(*b*) are enlarged views of the protrusion (pin) as a tray movement regulating means, and a hole (groove).
Figure 13B:
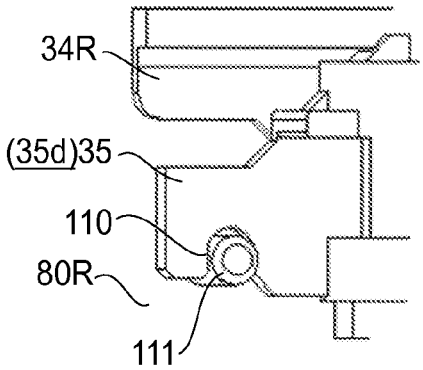
Figure 13C:
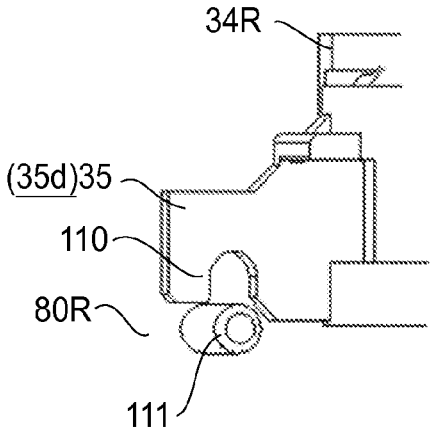

Further, the tray 35 (metallic rear section 35*d*) is provided with a notch 110, which is in the bottom right portion of the tray 35 (metallic rear section 35*d*) (FIGS. 13(*b*) and 14). On the other hand, the right frame 80R is provided with a pin 111. The pin 111 is fitted in the notch 110, contributing to the precise positioning of the tray 35 relative to the apparatus main assembly. Incidentally, as the means for precisely positioning the tray 35 relative to the apparatus main assembly, one of the above-mentioned left and right positioning means is sufficient.

As described above, the metallic rear section 35*d* is provided with the cartridge rotation stopping portion (positioning portion), and the regulating portions (protrusion 67 and notch 110) which prevent the tray 35 from moving in the direction parallel to the abovementioned tangential line, when the tray 35 is in the contact position. This structural arrangement is very effective to prevent the drum 1 from sustaining the frictional damages attributable to the unwanted shifting of the tray 35.

FIG. 11(*b*) shows the state of the mechanical linkage between the door 31 and the tray holding members 34L (34R), in which the door 31 is partially open. As the door 31, which is in the closed position as shown in FIG. 11(*a*), is opened, the holding members 34L and 34R are moved frontward, in the apparatus main assembly, by the movement of the door 31. More specifically, first, the tray holding members 34L and 34R are horizontally moved frontward in the apparatus main assembly, by the distance a1, since the pins 34*c* of the holding members 34L and 34R are horizontally guided by the distance a1 by the first guiding section 36*a*. FIG. 11(*b*) shows the state of the mechanical linkage, in which the holding members 34L and 34R have just finished being horizontally moved frontward by the distance a1. While the left and right holding members 34L and 34R are moved by the distance a1 as described above, the drum driving coupler and development roller driving coupler of each cartridge are disengaged from the counterparts on the apparatus main assembly side, and also, the pressure applied to each cartridge by the pressing member to keep the cartridge precisely positioned is removed. Further, the tip portion of the protrusion 67 remains in the hole 69, with which the stationary member 68 on the apparatus main assembly side is provided, remaining thereby precisely positioned, and therefore, preventing the tray 35 from following the movement of the holding members 34L and 34R.

As the door 31 is opened further, the holding members 34L and 34R are moved further frontward by the movement of the door 31. However, during this frontward movement of the holding members 34L and 34R, the pins 34*c* are guided by the second guiding section 36*b*, and therefore, the holding members 34L and 34R are moved frontward in the slantingly upward direction. During this slantingly upward movement of the holding members 34L and 34R, the electrical contact of each cartridge is disengaged from the counterpart on the apparatus main assembly, breaking thereby the electrical connection between the cartridge and apparatus main assembly.

Referring to FIG. 13(*a*), a referential character c stands for the distance by which the protrusion 67 enters the hole 69, and a referential character b stands for the distance by which the holding members 34L and 34R holding the tray 35 are vertically displaced while they are moved frontward in the slantingly upward direction. During this slantingly upward movement of the holding members 34L and 34R, as long as the protrusion of the tray 35 remains in the hole 69 (c>b), the protrusion 67 follows only the vertical component of the movement of the holding members 34L and 34R. Then, as the holding member 34L (34R) is displaced upward by a certain distance (c<b), the protrusion 67 comes out of the hole 69. With the provision of the above described structural arrangement, as long as the downwardly facing area of the peripheral surface of the photosensitive drum 1 of each of the cartridges PY, PM, PC, and PK in the tray 35 is in contact with the belt 13, the tray 35 is not allowed to horizontally move. Therefore, the drum 1 is prevented from sustaining the scratches which are attributable to the rubbing of the peripheral surface of the photosensitive drum 1 by the belt 13, and/or from developing the memories which also are attributable to the above described rubbing. Incidentally, the dimensional relationship between the notch 110 and pin 111, more specifically, the distance by which the pin 111 enters the notch 110, is the same as the above described dimensional relationship between the protrusion 67 and hole 69 (FIG. 13(*b*)).

FIG. 11(*c*) shows the state of the mechanical linkage, in which the door 31 is completely open. In this state, the holding members 34L and 34R have finished their slantingly upward movement effected by the second guiding section 36*b* of the guiding slot 36, and therefore, the pins 34*c* are in the third guiding section 36*c* of the guiding slot 36, which is horizontal. That is, the holding members 34L and 34R have been horizontally moved after they were moved slantingly upward. The reason for the provision of the above described structural arrangement is to keep the cartridges and holding members 34L and 34R steady in terms of the vertical direction, and also, to prevent the holding members 34L and 34R from shifting rearward when replacing the cartridge(s).

When the mechanical linkage is in the state shown in FIG. 13(*c*), the protrusion 67 and pin 111 have already come out of the hole 69 and notch 110, respectively, and therefore, the tray 35 is free from the positional restriction; in other words, the tray 35 can be horizontally moved (slid) relative to the holding members 34L and 34R in the fore-and-aft direction.

The above described protrusion 67 and hole 69 (notch 110 (recess) and pin 111 (protrusion)) make up the cartridge movement regulating means which prevents the drum 1 in each cartridge, and the belt 13, from moving relative to each other in the direction intersectional to the direction in which the drum 1 comes into contact with the belt 13, when the tray 35, which is a movable member, is in the latent image formation position in the apparatus main assembly. The restriction placed upon the tray 35 by this movement regulating means 67 and 69 to prevent the above described deviatory movement of the tray 35 is removed after the tray 35 is moved upward by the vertical component, that is, the component of the movement of the left and right tray holding members 34L and 34R, as the tray moving means, in the direction to separate the drum 1 from the belt 13.

The holding means 34L and 34R as the moving means move (first movement), while being guided by the first guiding section 36*a*, in the direction intersectional to the direction in which the drum 1, which each cartridge has, is separated from the belt 13. Next, the holding members 34L and 34R move (second movement) in the upwardly slanting direction, that is, the direction having two directional components: the abovementioned separative direction, and the direction intersectional to the separative direction. Thereafter, the holding members 34L and 34R move (third movement) in the intersectional direction. While the holding members 34L and 34R are making the first movement, the driving of the cartridges are ceased. Then, as the tray 35 follows the abovementioned separative movement of the holding members 34L and 34R, it becomes disengaged from the tray movement regulating means 67 and 69 (110 and 111).

As described above, the cartridges are mounted in the movable member (tray), which is vertically moved by the vertical component of the movement of the tray moving means (tray holding means) to make it easier for the cartridge(s) to be replaced. In other words, the present invention can improve an image forming apparatus in usability. Further, it can achieve the aforementioned object of providing an image forming apparatus which has a process cartridge drawer (tray) for simplifying a cartridge replacement operation, and yet, does not suffer from the problem that a photosensitive drum is scarred and/or develops memory by being rubbed by, or rubbing against, an intermediary transfer belt. Further, it does not require to increase an image forming apparatus in size to achieve the aforementioned object.

(Interface Portion)

Figure 14:
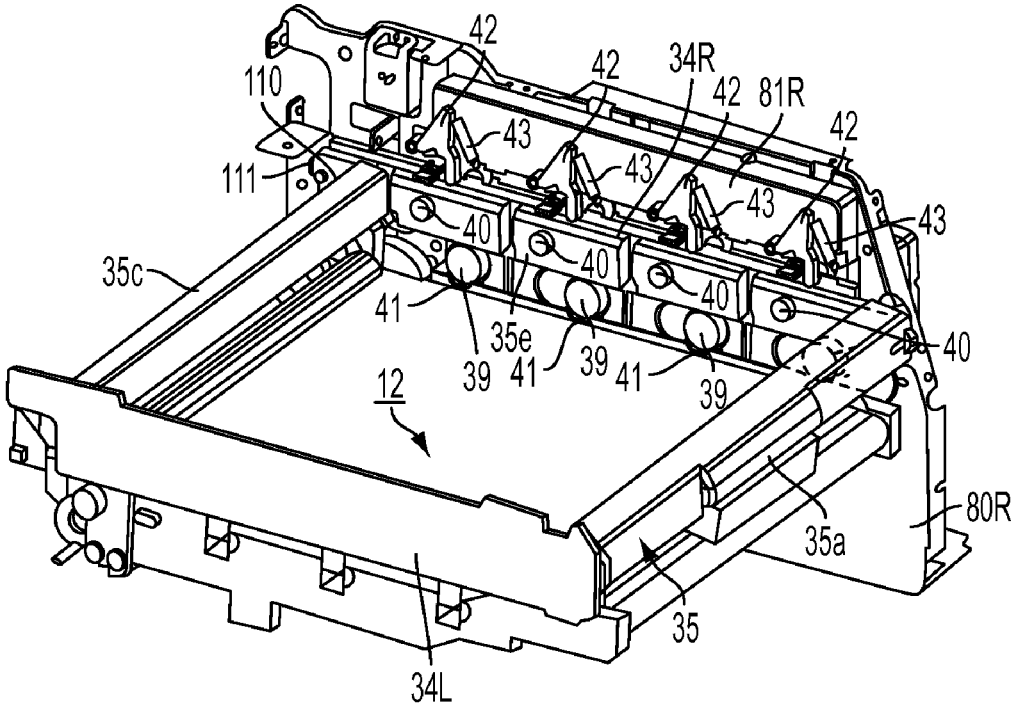
FIG. 14 is a perspective view (1) of the interfacial components and the portions thereof, which are located in the adjacencies of the cartridge bay, and are engaged or disengaged by the movement of the tray holding members.
Figure 15:
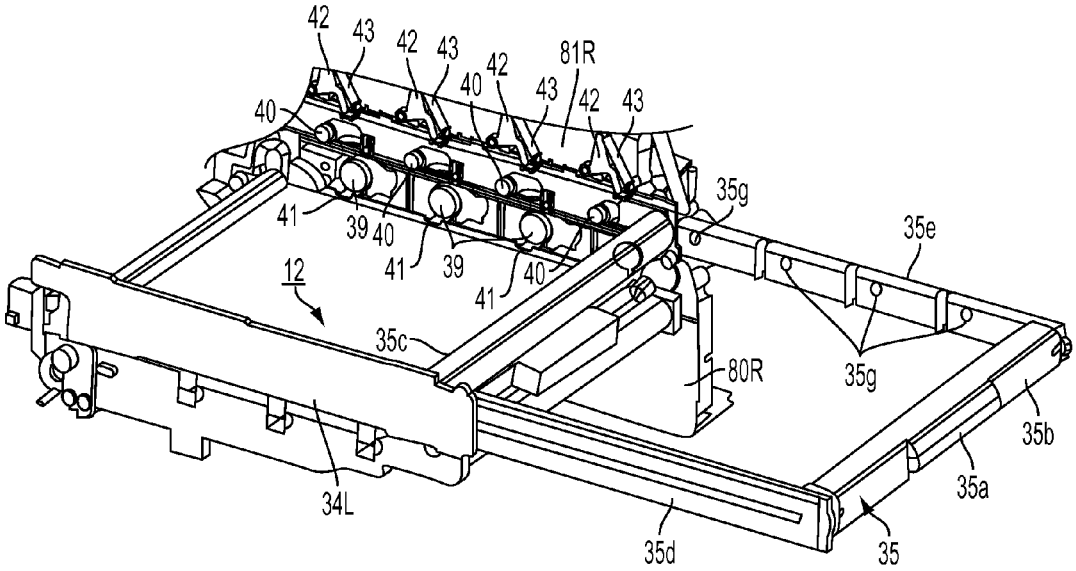
FIG. 15 is a perspective view (2) of the interfacial components and the portions thereof, which are located in the adjacencies of the cartridge bay, and are engaged or disengaged by the movement of the tray holding members.
Figure 16A:
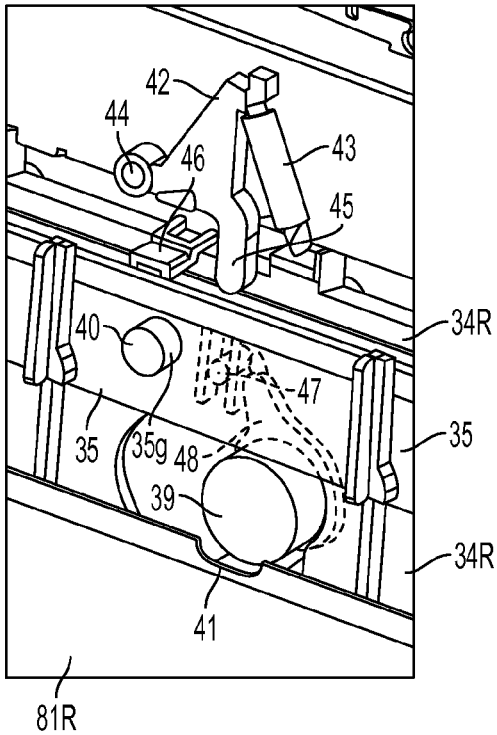
FIGS. 16(*a*) and 16(*b*) are perspective views (3) of the interfacial components and the portions thereof, which are located in the adjacencies of the cartridge bay, and are engaged or disengaged by the movement of the tray holding members.
Figure 16B:
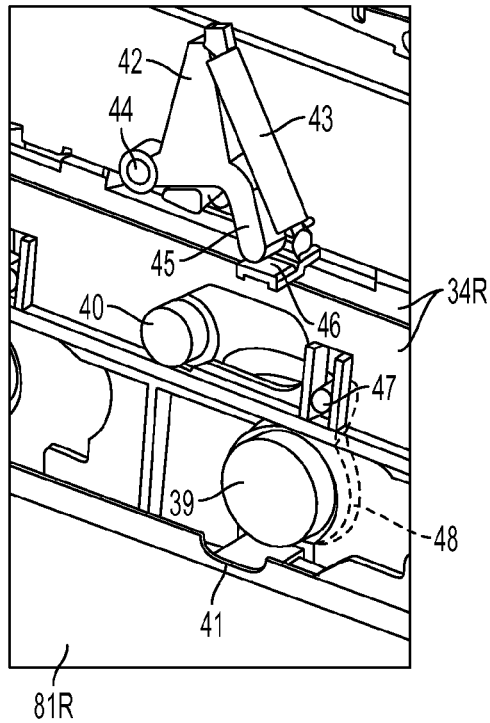

FIGS. 14, 15, 16(*a*), and 16(*b*) are illustrations drawn for describing the interfacial components which are engaged or disengaged by the movement of the tray holding members, and their adjacencies.

FIG. 14 is a perspective view of, primarily, the holding members 34L and 34R, tray 35, and right frame 80R, which are in the state in which the door 31 is closed as shown in FIGS. 1 and 2, and no cartridge is in the tray 35. FIG. 15 is a perspective view of, primarily, the holding members 34L and 34R, tray 35, and right frame 80R, which are in the state in which the door 31 is open, and the tray 35 has been completely pulled out.

On the right-hand side in the apparatus main assembly, drum driving force transmission couplers 39 and development roller driving force transmission couplers 40 (which hereafter will be referred to simply as drum coupler and development roller coupler, respectively) are disposed. The drum coupler 39 and development roller coupler 40 constitute the driving force output portions on the apparatus main assembly side, and couple with the driving force input portions 53 and 54 (couplers) (FIG. 7) on the cartridge side. The drum coupler 39 and development roller coupler 40 transmit rotational driving force to the drum 1 and development roller 3*a*, respectively, in each cartridge.

Figure 24:
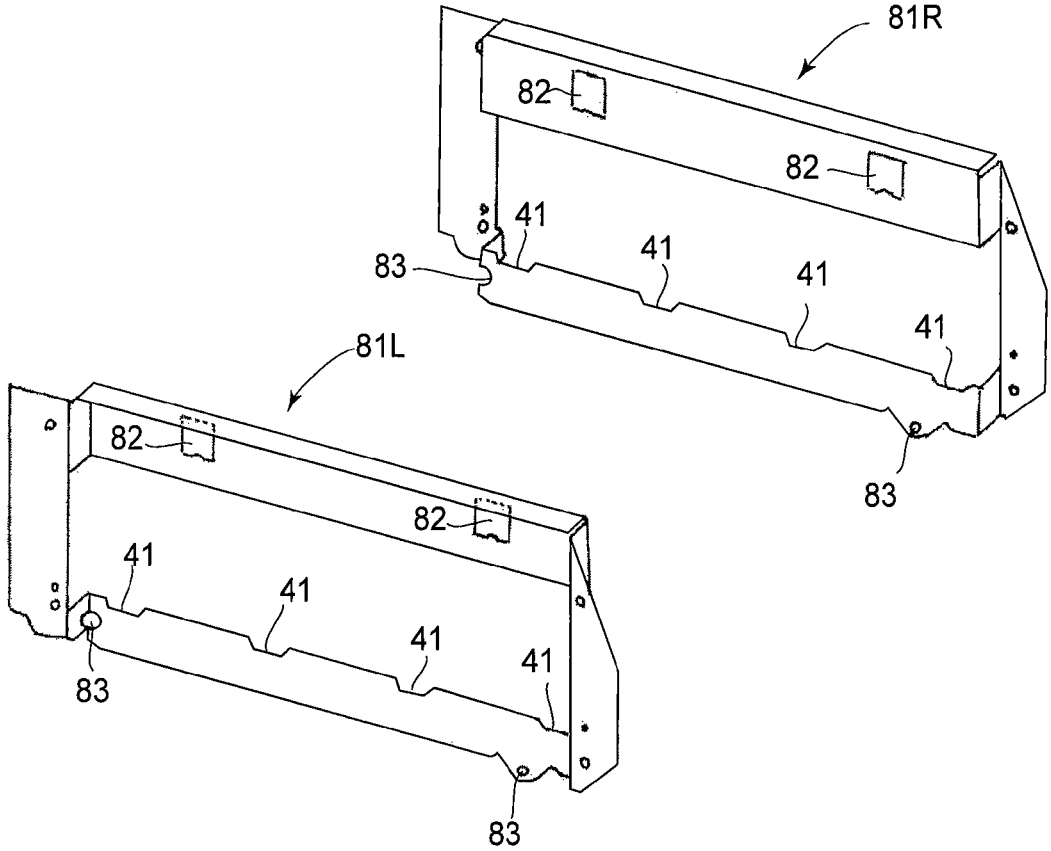
FIG. 24 is a perspective view of the left and right stays.
Figure 25:
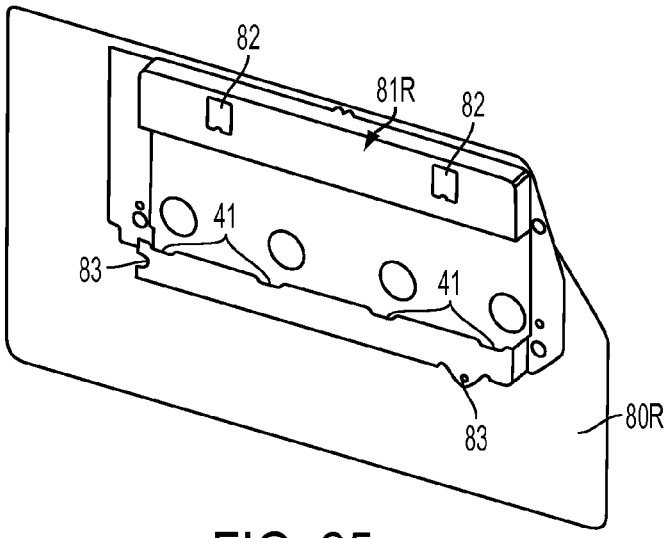
FIG. 25 is a drawing (1) showing the structure of the stay.
Figure 26:
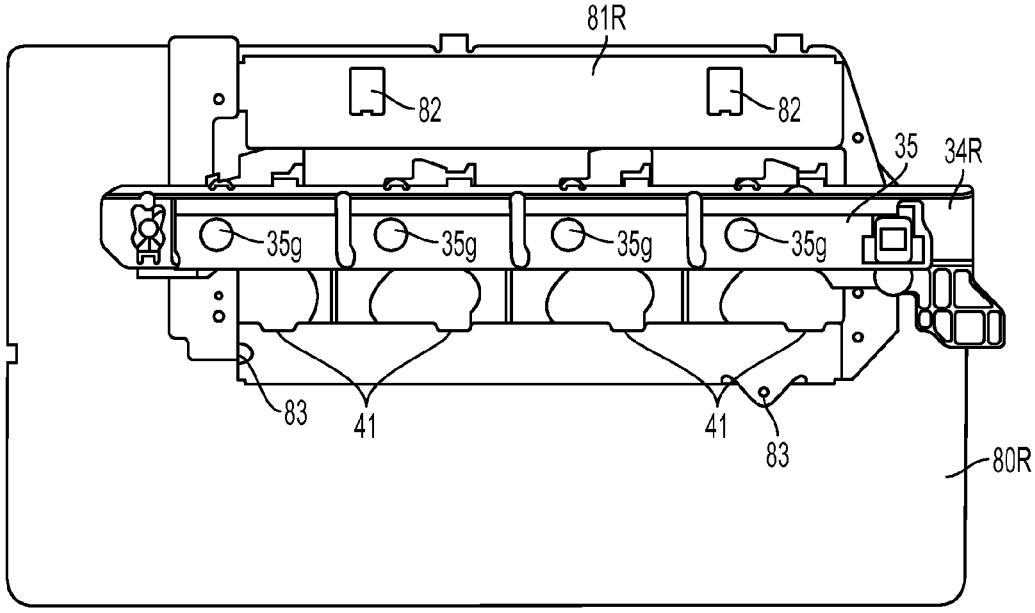
FIG. 26 is a drawing (2) showing the structure of the stay.
Figure 27:
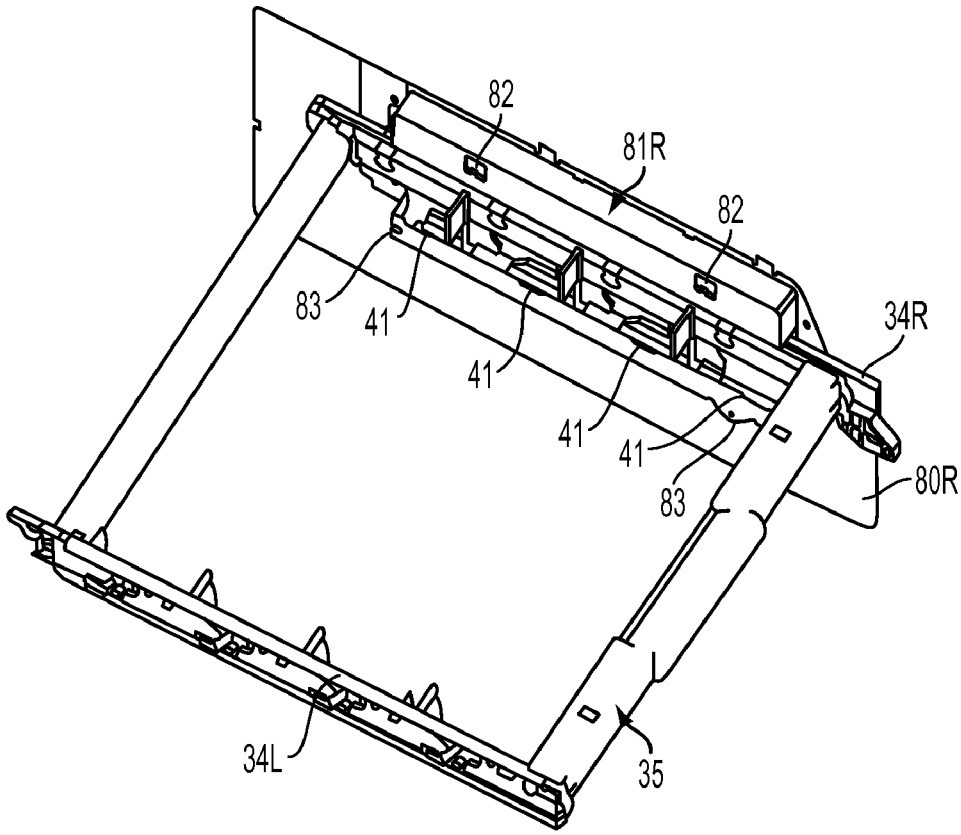
FIG. 27 is a drawing (3) showing the structure of the stay.
Figure 28:
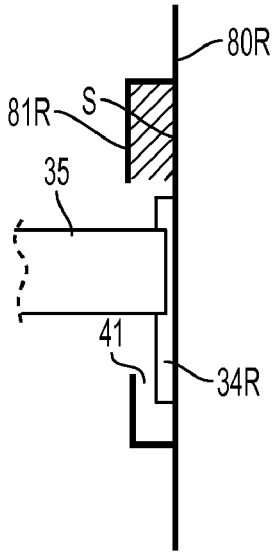
FIG. 28 is a drawing (4) showing the structure of the stay.

On both the left- and right-hand sides in the apparatus main assembly, cartridge positioning portions 41 are located, which are parts of the left and right stays 81L and 81R of the apparatus main assembly (FIG. 24). Each cartridge positioning portion 41 supports the corresponding bearing portions 51 (52) by the downwardly facing portion of the peripheral surface of the cartridge bearing portion 51 (52). Also on both the left and right sides in the apparatus main assembly, cartridge pressing members 42 are located, which are for keeping the cartridges secured in their preset positions. More specifically, each cartridge pressing member 42 presses on the left and right end portion of the top surface of the corresponding cartridge to keep stable the bearing portion 51 (52) supported by the above-mentioned cartridge positioning portion 41. The pressing member 42 is provided with a spring which generates the pressure to be applied by the pressing member 42.

FIG. 16(*a*) is an enlarged view of the pressing member 42, drum coupler 39, development roller coupler 40, and their adjacencies, which are shown in FIG. 14.

Each pressing member 42 is rotatably attached to the apparatus main assembly. The pressure generated by the abovementioned spring 43 is applied to the left (right) end portion of the top surface of the corresponding cartridge through the pressing lever portion 45 of the pressing member 42. When the pressing member 42 is in the state shown in FIG. 16(*b*), in which the pressing member 42 is not pressing the cartridge, the pressing level portion 45 of the pressing member 44 has been pushed up by the pressing member raising portion 46 of the holding member 34R, being kept away from the cartridge. That is, the pressure applied to the cartridge has been removed by the movement of the tray holding member 34R.

A release ring 48 (decoupling means for decoupling couplers to prevent driving force from being transmitted to cartridge) is provided with a release pin 47. The release ring 48 is fitted around the drum coupler 39 to retract the drum coupler 39. As the holding member 34R is moved, the release pin 47 is moved by the movement of the holding member 34R from the position shown in FIG. 16(*a*) to the position shown in FIG. 16(*b*), causing thereby the release ring 48 to move from the position shown in FIG. 16(*a*) to the position shown in FIG. 16(*b*). This movement of the release ring 48 causes the drum coupler 39 and development roller coupler 40 to retract to the positions shown in FIG. 16(*b*). That is, the drum coupler and development roller coupler of each cartridge are disengaged from the counterparts on the apparatus main assembly side.

FIG. 15 shows the states of the drum couplers 39, development roller couplers 40, and pressing members 42, and holding members 34L and 34R, in which the drum couplers 39 and development roller couplers 40 have been disengaged from the counterparts on the apparatus main assembly, by the movement of the holding members 34L and 34R, and the pressing members 42 have been disengaged from the cartridges by the movement of the holding members 34L and 34R. When the abovementioned components are in the states shown in FIG. 15, the tray 35 can be freely slid; the tray 35 can be moved in the direction to be pushed back into the apparatus main assembly, or in the direction to be pulled out of the apparatus main assembly.

As described above, the holding members 34 R and 34L are moved by the opening or closing movement of the door 31. Thus, in order to reduce the amount of force necessary to open or close the door 31, it is desired that the image forming apparatus is structured so that the timing with which the above-mentioned pressure is removed from the cartridges is slightly different from the timing with which the couplers are disengaged.

That is, the drum driving force transmission coupler 39, development roller driving force transmission coupler 40, and cartridge pressing member 42 are rendered slightly different in disengagement timing. More specifically, the release ring pin 47 and pressing member raising portion 46 are made different in position to render the drum coupler 39 and pressing member 43 slightly different in disengagement timing, and the four cartridges are rendered slightly different in the drum coupler disengagement timing and pressing member disengagement timing. Therefore, the employment of this structural arrangement spreads across a preset span of time, the amount of the load which bears on the door 31, reducing thereby the peak load. Therefore, it can reduce the amount of force which a user has to apply to open or close the door 31.

As described above, in this embodiment, not only are the driving force transmitting means (coupler 39 and 40)

retracted by the movement of the holding members 34R and 34L, but also, the tray 35 is vertically moved by the movement of the holding members 34R and 34L. That is, the role of disengaging the driving force transmitting means and the role of vertically moving the tray 35 are carried out by the same mechanism, contributing to the reduction of the apparatus main assembly size.

(Tray Position Regulating Means)

Figure 17:
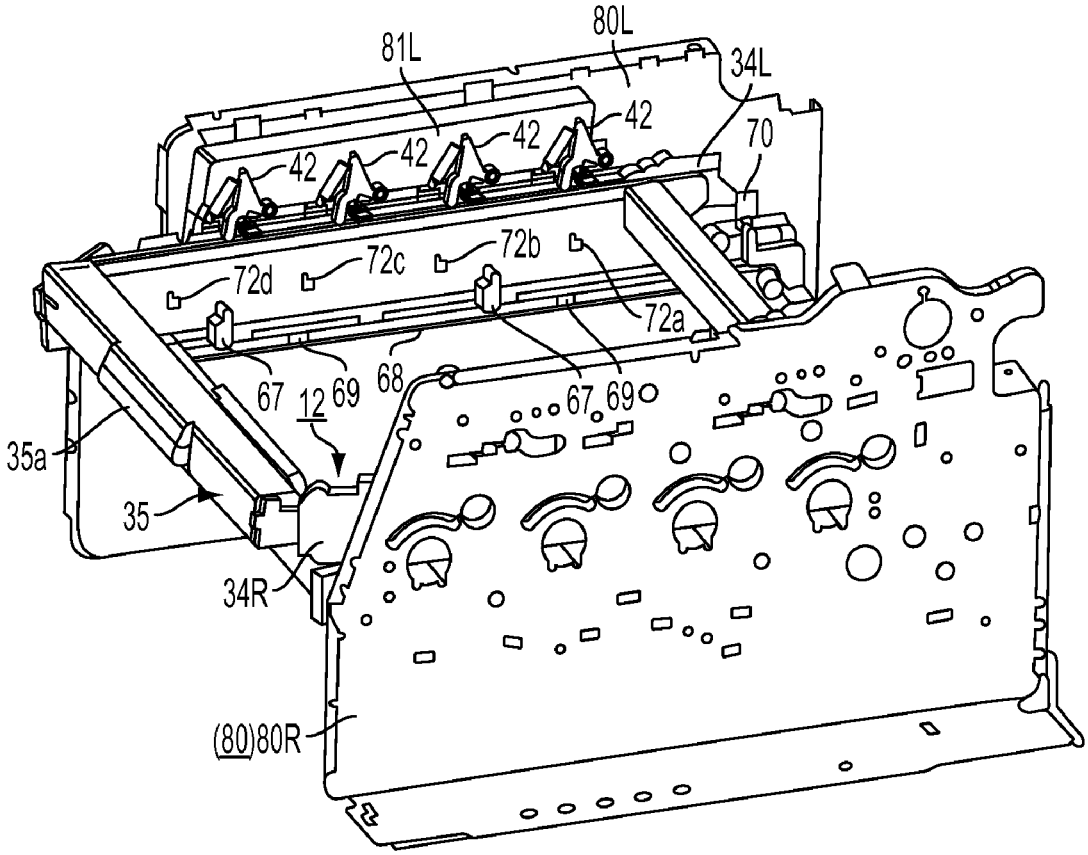
FIG. 17 is a drawing (1) showing the tray position regulating means.
Figure 18:
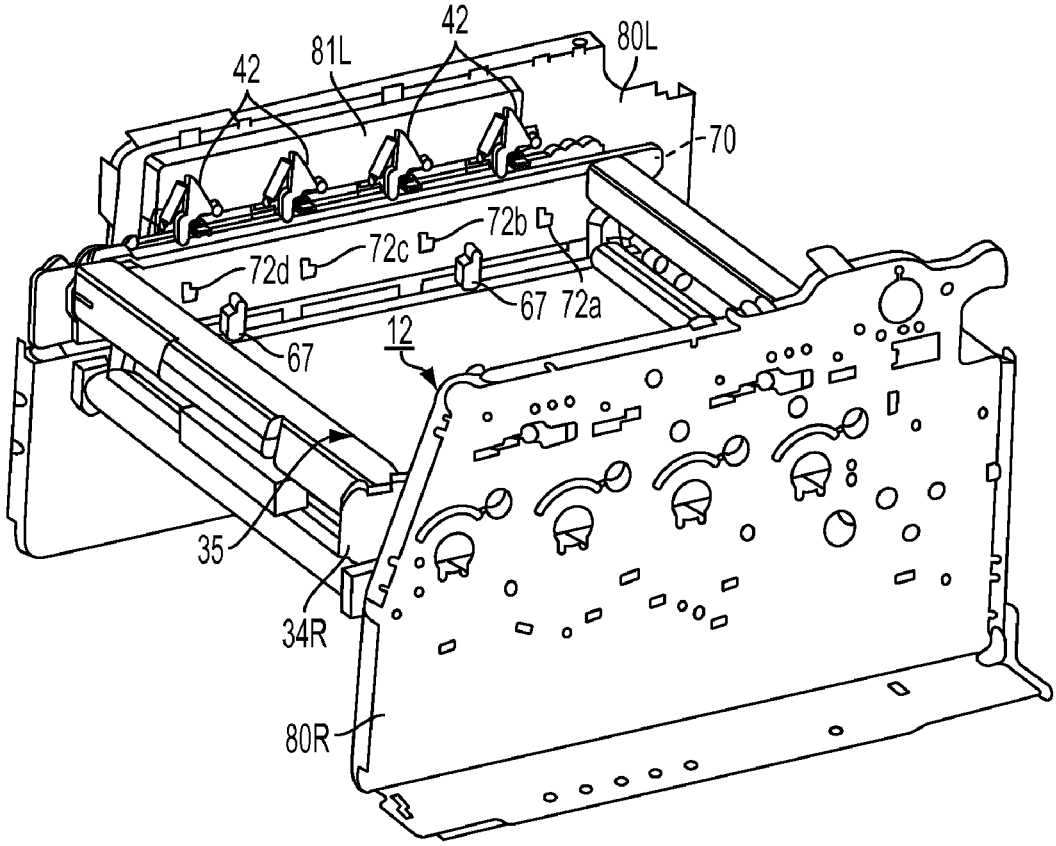
FIG. 18 is a drawing (2) showing the tray position regulating means.
Figure 19A:
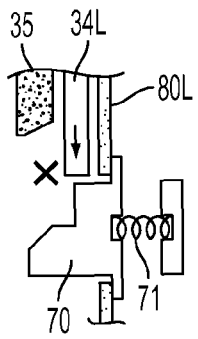
FIGS. 19(*a*) through 19(*c*) are drawings (3) showing the tray position regulating means.
Figure 19B:
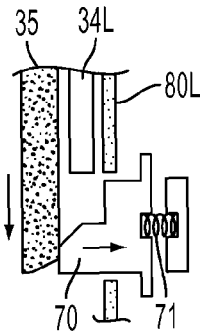
Figure 19C:
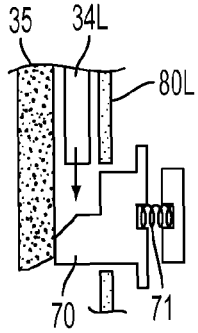

FIG. 17 shows the states of the holding members 34R and 34L, tray 35, and their adjacencies, in which the holding members 34R and 34L and tray 35 have been pushed up all the way by the movement of the door 31 and the tray 35, but have not been completely pushed back into the apparatus main assembly. FIG. 18 shows the states of the holding members 34R and 34L, tray 35, and their adjacencies, in which the tray 35 has been pushed back into the apparatus main assembly as far as possible. FIGS. 19(*a*) through 19(*c*) are schematic drawings showing the movement of the cartridge positioning regulating means disposed in the left rear portion in the apparatus main assembly.

If the door 31 is closed when the tray 35 is in the state shown in FIG. 17, in which the tray 35 has not been pushed back as far as possible, the rear end of the holding member 34R (34L) strikes a stopper 70 (first regulating member), as shown in FIG. 19(*a*) in which the stopper is in the position in which it regulates the closing movement of the door 31, while the holding member 34R (34L) is moved into the apparatus main assembly by the movement of the door 31. Therefore, the door 31 cannot be closed further to move the holding member 34R (34L) in the downwardly slanting direction. However, the tray 35 can be pushed back into the apparatus main assembly. At this point, therefore, the tray 35 is to be push inward of the apparatus main assembly so that the tray 35 will be completely pushed back into the apparatus main assembly as shown in FIG. 18. As the tray 35 is pushed inward of the apparatus main assembly, the rear end of the tray 35 (which constitutes first releasing member which disengages first regulating member) comes into contact with the stopper 70, and moves the stopper 70 from the regulating position to the releasing position (permissive position) against the resiliency of the spring 71, as shown in FIG. 19(*b*). When the tray 35 is in the position shown in FIG. 18 (FIG. 19(*b*)), the stopper 70 does not interfere with the rear end of the holding member 34R (34L) when the holding member 34R is moved rearward by the closing movement of the door 31. In FIG. 19(*b*), the stopper 70 is in the position in which it allows the door 31 to be closed, allowing therefore the holding member 34R to be moved rearward, indicated by an arrow mark in FIG. 19(*c*). Therefore, the door 31 can be closed all the way to rearwardly move the holding members 34R and 34L and tray 35 in the downwardly slanting direction.

That is, while the tray 35 is in a position which is away from the transitional position in the apparatus main assembly (while the position of the tray 35 is off from the transitional position toward the position in which the cartridges are mountable or removable), the stopper 70 prevents the door 31 from moving from the open position to the closed position. Further, as the tray 35 is moved into the transitional position in the apparatus main assembly, it removes the restriction which the stopper 70 places. That is, as the tray 35 removes the restriction which the stopper 70 places, allowing thereby the door 31 to move from the open position to the closed position.

In this embodiment, the cartridges can be easily replaced from the front side of the apparatus main assembly. More specifically, the image forming apparatus is provided with a cartridge tray (drawer), in which the cartridges are placed. When the cartridges are mounted into the apparatus main assembly, they are accurately positioned relative to the apparatus main assembly by the components on the apparatus main assembly side. The drawer (tray) loosely holds the cartridges, and is movable between the outermost position and the transitional position in the apparatus main assembly. Therefore, all that is necessary for a user to do in order to ensure that a cartridge, or cartridges, are precisely positioned in the preset positions when the user mount the cartridge(s) or replace the cartridge(s) in the apparatus main assembly is for the user to place the cartridge(s) in the cartridge tray (drawer) from directly above the tray, push the tray 35 into the transitional position, and then, close the door 31. That is, the user does not need to pay attention to the positioning of the cartridges relative to the apparatus main assembly. In other words, this embodiment can provide an image forming apparatus which is simple in the operation which must be carried out by the user to mount a cartridge into the apparatus main assembly, or replace a cartridge in the apparatus main assembly, and yet, ensures that as a cartridge is mounted into the apparatus main assembly, it is precisely positioned relative to the apparatus main assembly.

Incidentally, if the tray 35 is operated before the tray 35 is fully raised, for example, when the door 31 is half open, it is possible that the drum 1 in a cartridge will rub against the belt 13. If the drum 1 rubs against the belt 13, it is possible that a defective image will be formed. In this embodiment, however, the image forming apparatus is provided with the member which regulates the movement of the door 31, and the position of which is controlled by the positioned of the tray 35, and/or the member which regulates the movement of the tray, and the position of which is controlled by the opening or closing movement of the door 31, so that unless the door 31 is fully opened, the tray 35 cannot be moved, or so that unless the tray 35 is completely pushed back into the apparatus main assembly, the door 31 cannot be closed. Therefore, a user is prevented from making operational errors when mounting a cartridge into the apparatus main assembly, or replacing a cartridge in the apparatus main assembly.

Incidentally, instead of providing the above described stopper 70 for regulating the movement of the holding member 34, the above described protrusion 67 and hole 69 (FIGS. 11(*a*), 11(*b*), 11(*c*), 13(*a*), and 13(*b*) can be utilized. This setup will be described next, with reference to FIGS. 17, 18, 19(*a*), 19(*b*), and 19(*c*).

When the tray 35 is in the state shown in FIG. 17, in which the tray has not been completely pushed back into the apparatus main assembly, the protrusion 67 of the tray 35 is not in alignment with the hole 69 of the intermediary transfer belt supporting member 68 (second regulating member). If an attempt is made to close the door 31 when the tray 35 is in this state, the holding members 34R and 34L are lowered by the closing movement of the door 31, through the connective arms 37R and 37L, and therefore, the tray 35 is lowered. However, the protrusion 67 strikes a regulating portion 66 (edges) provided around the hole 69, preventing thereby the door 31 from being closed.

Figure 20A:
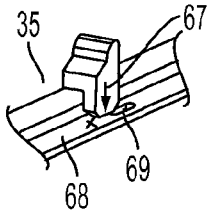
FIGS. 20(*a*) through 20(*c*) are drawings (4) showing the tray position regulating means.
Figure 20B:
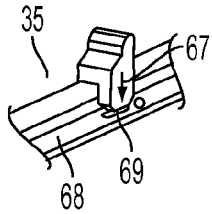
Figure 20C:
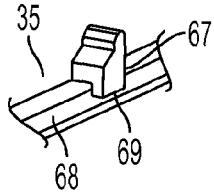

On the other hand, if the tray 35 is lowered when the tray 35 is in the state shown in FIG. 18, in which it has been completely pushed back into the apparatus main assembly, the protrusion 67 enters the hole 69 as shown in FIGS. 20(*b*) and 20(*c*); the protrusion 67 as an engaging portion engages with the hole 69 as an portion to be engaged. In other words, the hole 69 functions as the portion which allows the tray 35 to be lowered. Therefore, the door 31 can be closed to lower the tray holding members 34R and 34L to lower the tray 35.

Therefore, the tray 35 can be lowered only when the tray 35 is in the transitional position in the apparatus main assembly, in terms of the horizontal direction of the apparatus main assembly. Therefore, each cartridge is precisely positioned by the cartridge positioning member 41.

Referring to FIGS. 17 and 18, in this embodiment, each of the left and right sides of the apparatus main assembly is provided with two protrusions 67 which are the same in shape, and two hole 69 which are the same in shape. However, the number and shape of the protrusions 67 and holes 69 do not need to be as shown in FIGS. 17, 18, 20(*a*), 20(*b*), and 20(*c*). Further, when two or more protrusions and holes are provided, they do not need to be the same in shape. Further, the manner in which each protrusion 67 fits into the corresponding hole 69 does not need to be exactly as shown in FIGS. 17, 18, 20(*a*), 20(*b*), and 20(*c*). Moreover, the hole 69 does not need to be a part of the intermediary transfer belt supporting member. The role which the protrusion 67 and hole 69 play can be played by the combination of the pin 111 and notch 110, just as effectively as by the combination of the protrusion 67 and hole 69. Also in the case in which the pin 111 and notch 110 are used, their number, location, and shape do not need to be exactly as shown in FIG. 14.

(Structure Arrangement for Supplying Cartridge with Power)

Figure 21:
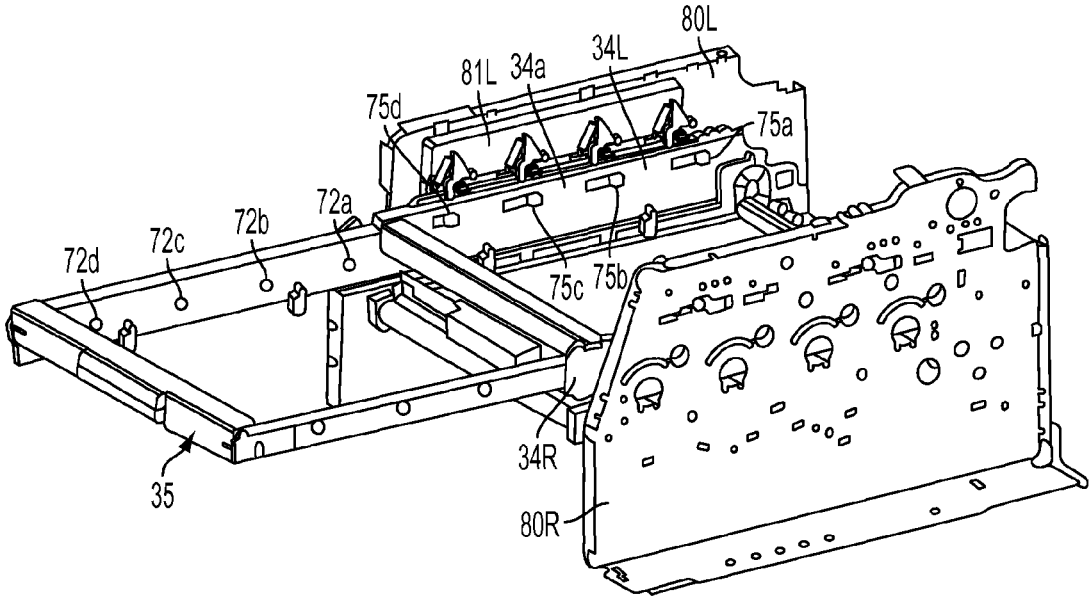
FIG. 21 is a drawing (1) showing the means for supplying electric power to a cartridge.
Figure 22:
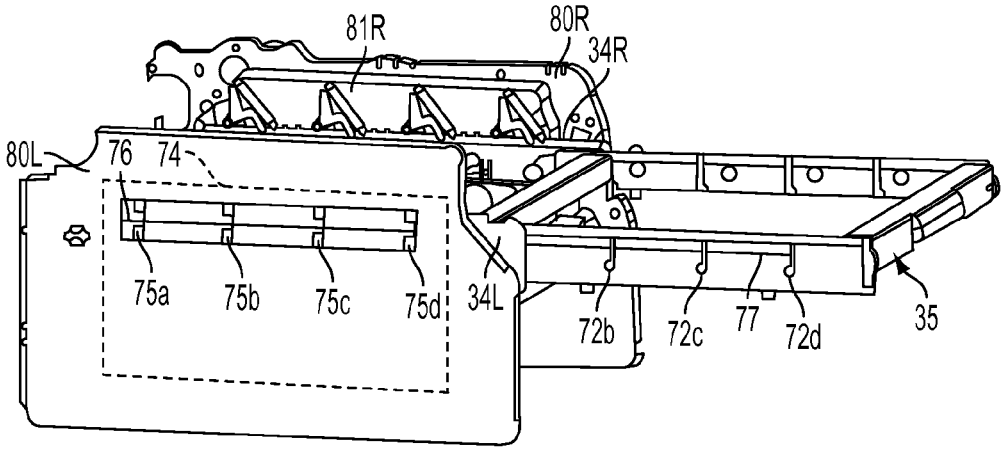
FIG. 22 is a drawing (2) showing the means for supplying electric power to a cartridge.
Figure 23A:
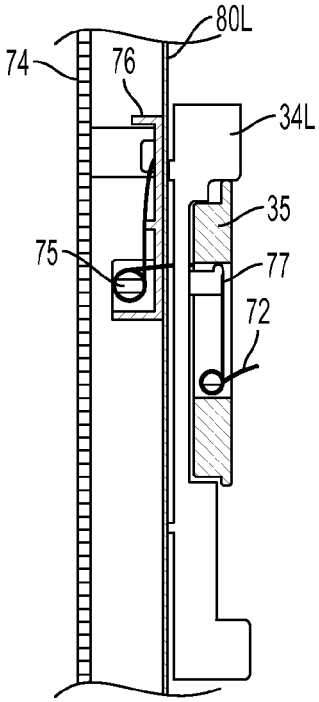
FIG. 23 is a drawing (3) showing the means for supplying electric power to a cartridge.
Figure 23B:
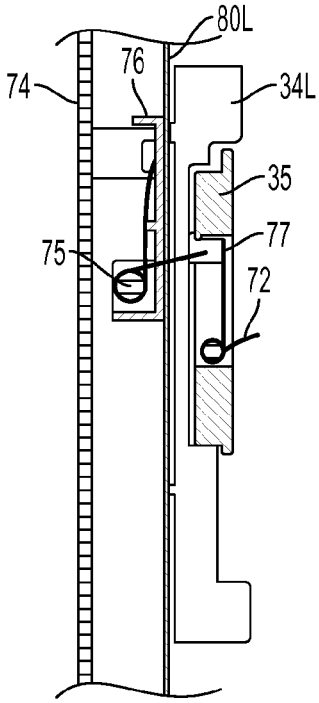

FIGS. 21-23 are drawings for describing the method for supplying electric power to each cartridge from the apparatus main assembly.

FIGS. 21 and 22 show the state of the tray 35, tray holding members 34R and 34L, and their adjacencies, in which the tray 35 has been completely pulled out by opening the door 31. The tray 35 is provided with multiple intermediary electrical contact springs 72*a*-72*d*, which are aligned in the direction parallel to the horizontal direction of the apparatus main assembly. One end of each spring 72 is electrically connected to the corresponding electrical contact (FIG. 8) of the cartridge. That is, the tray 35 is provided with the intermediary electrical contacts 72*a*-72*d*, which are electrically connected to the electrical contacts 55 of the cartridge.

The apparatus main assembly (main assembly frame 101) is provided with a power supply 74, and electrical contact springs 75*a*-75*d* connected to the power supply 74. The power supply 74 is located on the outward side of the left frame 80L. The electrical contact springs 75*a*-75*d* are aligned in the direction parallel to the horizontal direction of the apparatus main assembly. The electrical contact springs 75*a*-75*d* are put through the hole of the left frame 80L and the hole of the holding member 34L, and are extended toward the tray 35.

FIGS. 23(*a*) and 23(*b*) show how the intermediary electrical contact spring 72, with which the tray 35 is provided, is electrically connected to, or disconnected from, the electrical contact spring 75 on the apparatus main assembly side. FIGS. 23(*a*) and 23(*b*) show the same portions of a sectional view of the tray 35, intermediary electrical contact spring 72, left tray holding member 34L, left frame 80L, electrical contact springs 75 on the apparatus main assembly side, electrical contact spring holder 76 on the apparatus main assembly side, and power supply portion 74 on the apparatus main assembly side, as seen from the front side of the apparatus main assembly.

FIG. 23(*a*) shows the state of the abovementioned components, in which the door 31 is in the closed position, and the left tray holding member 34L and tray 35 are in their latent image formation positions, into which they have been lowered. When they are in this state, the electrical contact spring 75 on the apparatus main assembly side is electrically in contact with the intermediary electrical contact spring 72.

FIG. 23(*b*) shows the state of the abovementioned components, in which the door 31 is in the open position, and the left tray holding member 34L and tray 35 are at their top levels to which they have been raised from the latent image formation positions. When they are in this state, there is no electrical contact between the electrical contact spring 75 on the apparatus main assembly side and the intermediary electrical contact spring 72. In order to prevent the tray 35 from contacting the portion of the electrical contact spring 75 on the apparatus main assembly, which is protruding toward the tray 35 beyond the holding member 34L, the tray 35 is provided with a groove 77 which extends in the fore-and-aft direction of the apparatus main assembly. Therefore, the tray 35 can be pulled out without coming in contact with the electrical contact spring 75 of the apparatus main assembly.

More specifically, the apparatus main assembly is provided with electrical contacts 75*a*-75*d*, which are disposed so that their positions do not coincide with the path of the intermediary electrical contacts 72*a*-72*d*. The apparatus main assembly is structured so that the electrical connection between the intermediary electrical contacts and corresponding electrical contacts of the apparatus main assembly can be broken by moving upward (raising) the tray 35 from the latent image formation position by the holding members 34L and 34R, and can be established by moving downward (lowering) the tray 35 toward its latent image formation position by the holding members 34L and 34R.

FIGS. 21-23 show the power supplying method for supplying one section of each cartridge, which needs to be supplied with electric power, with electric power through one electrical contact of the apparatus main assembly, which is dedicated to this section of the cartridge, and the intermediary elastic electric contact dedicated to this section of the cartridge. However, this setup can also be used when each cartridge has multiple sections which need to be supplied with electric power. Further, this setup can be used even for a cartridge having multiple sections which need to be supplied with electric power and are different in the position in terms of the vertical direction of the apparatus main assembly; all that is necessary is to provide the tray with the same number of grooves, as the number of the sections of the cartridge, which need to be supplied with electric power, which match in vertical position the electrical contacts of the cartridge, which are connected to the sections of the cartridge which need to be supplied with electric power.

Further, when the multiple cartridges are the same in the bias to be applied thereto, the tray 35 may be provided with an electrically conductive member, which functions as an intermediary electrical contact, and can be connected to, or disconnected from, the single electrical contact of the apparatus main assembly. To this electrically conductive member of the tray 35, one end of each of the multiple electrical contact springs is electrically connected, and the other end is rendered electrically connectible to, or disconnectable from, the corresponding electrical contact of the cartridge, which is connected to one of the cartridge sections which need to be supplied with electric power. This structural arrangement makes it possible to reduce the number of the electrical junctions between the intermediary electrical contact spring and electrical contact springs of the apparatus main assembly. Incidentally, the shape of the electrical contact spring of the apparatus main assembly, shape of the intermediary electrical contact spring, and the direction of the contact pressure in each electrical junction, do not need to be as shown in FIGS. 21-23.

That is, an image forming apparatus may be structured so that the electrically conductive member is disposed in the tray 35, and the number of the electrical junctions between the intermediary electrical contacts and the electrical contacts of each cartridge is greater than the number of the electrical junctions between the intermediary electrical contacts and the electrical contacts of the apparatus main assembly. The employment of such a structural arrangement can make it possible to reduce the component count of an image forming apparatus, making it therefore possible to reduce the cost of the image forming apparatus, provided that the image forming apparatus is designed so that the multiple cartridges, which are different in the color of the toner they use, are the same in voltage requirement.

As described above, the cartridges are placed in the movable member (tray 35) so that they can be easily accessed from the front side of the apparatus main assembly to replace them, and the movable member is provided with an intermediary electrical contacts which are connected to, or separated from, the electrical contacts of the apparatus main assembly, by the upward or downward displacement of the movable member. Therefore, it is possible to provide an image forming apparatus which employs a process cartridge drawer (tray) system which makes it easier to replace the process cartridges, and yet, is no higher in cost and size than an image forming apparatus in accordance with the prior art. Incidentally, in the preferred embodiment described above, the transferring member was the transfer belt. However, the present invention is also applicable to an image forming apparatus which does not employ the transfer belt, and instead, employs a conveyance belt for conveying recording medium onto which a toner image is directly transferred from an image bearing member.

Further, the movable member is displaced upward or downward by the movement of the member which exposes or covers the opening of the apparatus main assembly through which a cartridge is mounted or removed. Therefore, the method for replacing any of the cartridges in the apparatus main assembly is virtually self explanatory to a user.

Further, multiple electrical contacts are horizontally aligned; they are rendered the same in vertical position. Therefore, in terms of the vertical direction of the apparatus main assembly, they do not take up as much internal space of the apparatus main assembly as those of an image forming apparatus in accordance with the prior art. Therefore, this embodiment can reduce the size of the main assembly of an image forming apparatus.

(Stay)

FIG. 24 is a perspective view of the left and right stays 81L and 81R, respectively. These stays 81L and 81R are screwed to the inward surfaces of the left and right frames 80L and 80R, respectively. That is, the stays 81L and 81R oppose each other. It is in the space between the left and right stays 81L and 81R that the scanner unit 11, tray holding members 34R and 34L, and belt unit 12 are disposed.

The stays 81L and 81R are components formed through the process of folding and process of punching. Each stay 81 is provided with a scanner unit positioning portion 82, a cartridge positioning portion 41, and a belt unit positioning portion 83. Therefore, the level of accuracy at which the scanner unit 11, cartridges PY, PM, PC, and PK, and belt unit 12 are positioned relative to each other can be determined by the preciseness of the stays 81L and 8R alone.

Further, the scanner unit positioning portion 82, cartridge positioning portion 41, and belt unit positioning portion 83 are in the same plane, that is, the plane of the stay. Therefore, when manufacturing the stays, all the positioning portions can be formed through a single punching (piecing) process after the folding process. Therefore, the stays can be manufactured at a higher level of precision.

Figure 29:
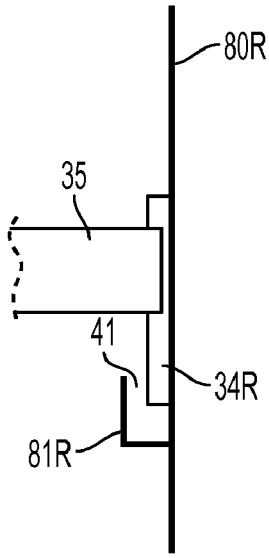
FIG. 29 is a drawing showing a comparative structural arrangement.

Referring to FIGS. 25-28, the stay 81R (81L) is shaped so that a recess is provided between its cartridge positioning portion 41 and scanner unit positioning portion 82. The provision of this recess makes it possible to move the tray 35 when replacing the cartridges. If the scanner unit positioning portion is attached to the frame 80R (80L) as shown in FIG. 29, a space S shown in FIG. 28 cannot be utilized, and therefore, it is possible that the apparatus main assembly may be increased in size. Further, the distance from the scanner unit 11 to the frame is greater, which makes it more likely to allow the scanner unit 11 to vibrate. Therefore, it is possible that banding will deteriorates.

The stay 81R (81L) is perpendicularly bent at the line between the portion by which it is fixed to the frames 80R (80L) and the rest. Therefore, the scanner unit positioning portion 82 and cartridge positioning portion 41 are prevented from being bent by the weight of the scanner unit 11 and cartridges, and/or by the forces applied to the scanner unit 11 and cartridges to press them against the scanner unit positioning portions 82 and cartridge positioning portions 41.

That is, the stay 81R (81L) has the first positioning portions 41 for accurately positioning the cartridges, and the second positioning portions 82 for accurately positioning the scanner unit 11 which forms an electrostatic latent image on the electrophotographic photosensitive member in each cartridge. Therefore, not only is it assured that the cartridges are positioned at a high level of accuracy relative to the scanner unit 11, but also, the apparatus main assembly is increased in rigidity. Using metallic plate as the material for the stay makes it easier to ensure that the cartridges and scanner are positioned at a high level of accuracy relative to each other. Further, the stay 81R (81L) has the third positioning portion 83 for accurately positioning the belt unit 12. Since the stay has the portion for accurately positioning belt unit, it is easier to ensure that the cartridges are positioned at a high level of accuracy relative to the belt unit.

Further, the stay 81R (81L) has the recess which accommodates a part of the tray 35 when the tray 35 is moved. In terms of the vertical direction of the apparatus main assembly, this recess is between the first positioning portion 41 and second positioning portion 32. In terms of the direction parallel to the axial direction of the drum, this recess indents toward the lateral panels of the main frame, with reference to the first positioning portions 41 and second positioning portions 82.

Further, each of the first positioning portions 41 belongs to a portion of the stay, which is formed by bending, in the vertical direction of the apparatus main assembly, the portion of the stay, by which the stay is attached to the main frame, and each of the second positioning portions 82 belongs to another portion of the stay, which is also formed by bending, in the vertical direction of the apparatus main assembly, another portion of the stay, by which the stay is attached to the main assembly.

Attaching the stays to the lateral frames of the apparatus main assembly, that is, the frames which are perpendicular to the drum axis, makes it easier to highly accurately position the various components. The cartridge positioning portions and scanner positioning portions are formed as parts of the portion of the stay, which are effected by perpendicularly bending the precursor of the stay along the line between the portion by which the stay is attached to the apparatus main assembly and the rest. Therefore, the stays in this embodiment are stronger than the stays of an image forming apparatus in accordance with the prior art.

The present invention is also applicable to an image forming apparatus which has only one stay, that is, either the left stay 81L or right stay 81R.

Not only can the above described preferred embodiment prevent the electrophotographic photosensitive member in a process cartridge from sustaining the scratches attributable to the rubbing of the photosensitive drum, but also, it can prevent the photosensitive member from developing memories attributable to the rubbing of the photosensitive drum.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 004023/2006 filed Jan. 11, 2006 which is hereby incorporated by reference.

What is claimed is:

1. An image forming apparatus for forming an image on a recording material, said image forming apparatus comprising:

a main assembly having an engaging portion;

a plurality of photosensitive members on which toner images are to be formed;

an intermediary transfer member that receives toner images from said photosensitive members and carries the toner images to a transfer portion that transfers the toner image onto the recording material;

a drawer member that supports said photosensitive members, said drawer member being drawable outwardly of said main assembly;

a supporting member supporting said drawer member and movable, in a state of supporting the drawer member, from a first position in which said photosensitive members contact said intermediary transfer member to a second position in which said photosensitive members are spaced away from said intermediary transfer member, wherein when said supporting member takes the second position, said drawer member is drawable outwardly of said main assembly in a direction along which said photosensitive members are arranged; and a portion to be engaged which is provided on said drawer member and which is engaged with said engaging portion to prevent said photosensitive members from moving in the direction relative to said intermediary transfer member when said supporting member takes the first position, wherein when said supporting member moves from the first position to the second position, said drawer member is moved to space said photosensitive members from said intermediary transfer member without movement in the direction along which said photosensitive members are arranged, and then engagement between said engaging portion is disengaged from said portion to be engaged.

2. An apparatus according to claim 1, wherein said engaging portion includes a projection, and said portion to be engaged includes a recess engageable with said projection.

3. An apparatus according to claim 1, further comprising a frame, wherein said engaging portion is provided on said frame.

4. An apparatus according to claim 1, wherein said engaging portion includes a recess, and said portion to be engaged includes a projection engageable with said recess.

5. An apparatus according to claim 1, wherein said main assembly further includes a frame provided with an opening through which said drawer member is capable of passing, and a door which is movable between a closing position for closing said opening and an opening position in interrelation with said supporting member, wherein when said door takes the closing position, said supporting member takes the first position, and when the door takes the opening position, said supporting member takes the second position.

6. An apparatus according to claim 1, wherein said drawer member removably supports a process cartridge provided with one of said photosensitive members and process means actable on said one of said photosensitive members.

7. An image forming apparatus for forming an image on a recording material, said image forming apparatus comprising:

a main assembly having an engaging portion;

a plurality of photosensitive members on which toner images are to be formed;

a feeding belt that feeds the recording material to transfer the toner images from said photosensitive members directly onto the recording material;

a drawer member that supports said photosensitive members, said drawer member being drawable outwardly of said main assembly;

a supporting member supporting said drawer member and movable, in a state of supporting the drawer member, from a first position in which said photosensitive members contact said feeding belt to a second position in which said photosensitive members are spaced away from said feeding belt, wherein when said supporting member takes the second position, said drawer member is drawable outwardly of said main assembly in a direction along which said photosensitive members are arranged; and a portion to be engaged which is provided on said drawer member and which is engaged with said engaging portion to prevent said photosensitive members from moving in the direction relative to said feeding belt when said supporting member takes the first position;

wherein when said supporting member moves from the first position to the second position, said drawer member is moved to space said photosensitive members from said feeding belt without movement in the direction along which said photosensitive members are arranged, and then engagement between said engaging portion is disengaged from said portion to be engaged.

8. An apparatus according to claim 7, wherein said engaging portion includes a projection, and said portion to be engaged includes a recess engageable with said projection.

9. An apparatus according to claim 7, further comprising a frame, wherein said engaging portion is provided on said frame.

10. An apparatus according to claim 7, wherein said engaging portion includes a recess, and said portion to be engaged includes a projection engageable with said recess.

11. An apparatus according to claim 7, wherein said main assembly further includes a frame provided with an opening through which said drawer member is capable of passing, and a door which is movable between a closing position for closing said opening and an opening position in interrelation with said supporting member, wherein when said door takes the closing position, said supporting member takes the first position, and when the door takes the opening position, said supporting member takes the second position.

12. An apparatus according to claim 7, wherein said drawer member removably supports a process cartridge provided with one of said photosensitive members and process means actable on said one of said photosensitive members.

* * * * *